US011225928B2

(12) United States Patent
Kanno

(10) Patent No.: US 11,225,928 B2
(45) Date of Patent: Jan. 18, 2022

(54) FUEL INJECTION SYSTEM

(71) Applicant: DENSO CORPORATION, Kariya (JP)

(72) Inventor: Hiroshi Kanno, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/322,006

(22) Filed: May 17, 2021

(65) Prior Publication Data

US 2021/0270203 A1 Sep. 2, 2021

Related U.S. Application Data

(63) Continuation of application No. PCT/JP2019/045127, filed on Nov. 18, 2019.

(30) Foreign Application Priority Data

Nov. 19, 2018 (JP) ..... JP2018-216792

(51) Int. Cl.

| | |
|---|---|
| ***F02D 7/00*** | (2006.01) |
| ***F02D 41/40*** | (2006.01) |
| ***F02D 41/14*** | (2006.01) |
| ***F02M 47/02*** | (2006.01) |
| ***F02M 61/10*** | (2006.01) |

(52) U.S. Cl.

CPC ..... *F02D 41/401* (2013.01); *F02D 41/1401* (2013.01); *F02M 47/027* (2013.01); *F02M 61/10* (2013.01); *F02D 2041/1431* (2013.01); *F02D 2200/0602* (2013.01)

(58) Field of Classification Search

CPC .... F02D 41/30; F02D 41/402; F02D 2250/04; F02D 2200/0602; F02D 41/20; F02D 41/2096; F02D 2041/2055; F02D 2041/2058; F02D 41/1433

USPC ..... 123/478, 480, 486, 490, 491, 492, 493

See application file for complete search history.

(56) References Cited

U.S. PATENT DOCUMENTS

| | | | | |
|---|---|---|---|---|
| 4,630,588 A * | 12/1986 | Sagawa | F02M 63/0215 | 123/506 |
| 4,676,214 A * | 6/1987 | Kato | F02D 41/408 | 123/446 |
| 6,543,424 B1 * | 4/2003 | Yamaguchi | C23C 28/048 | 123/495 |
| 2009/0056676 A1 * | 3/2009 | Nakata | F02M 57/005 | 123/478 |

(Continued)

FOREIGN PATENT DOCUMENTS

| | | |
|---|---|---|
| JP | 2009-97385 | 5/2009 |
| JP | 2011-7203 | 1/2011 |

*Primary Examiner* — John Kwon

(74) *Attorney, Agent, or Firm* — Nixon & Vanderhye P.C.

(57) ABSTRACT

A pressure detection unit detects a fuel pressure in high-pressure fuel passages. A drive control unit controls opening and closing of pressure adjusting valves based on a drive command signal output to the fuel injection valve. An acquisition unit acquires an inflection point of the fuel pressure detected by the pressure detection unit and an inclination of the fuel pressure after the inflection point appears, after an output of the drive command signal. A delay time computation unit computes a response delay time of the pressure adjusting valve with respect to the drive command signal for each of the first on-off valve and the second on-off valve based on the inflection point and the inclination acquired by the acquisition unit.

5 Claims, 13 Drawing Sheets

(56) References Cited

U.S. PATENT DOCUMENTS

| | | | | |
|---|---|---|---|---|
| 2009/0056677 | A1* | 3/2009 | Nakata | F02D 41/2435<br>123/480 |
| 2009/0063011 | A1* | 3/2009 | Nakata | F02M 57/005<br>701/103 |
| 2013/0327300 | A1* | 12/2013 | Nonoyama | F02D 41/30<br>123/478 |

* cited by examiner

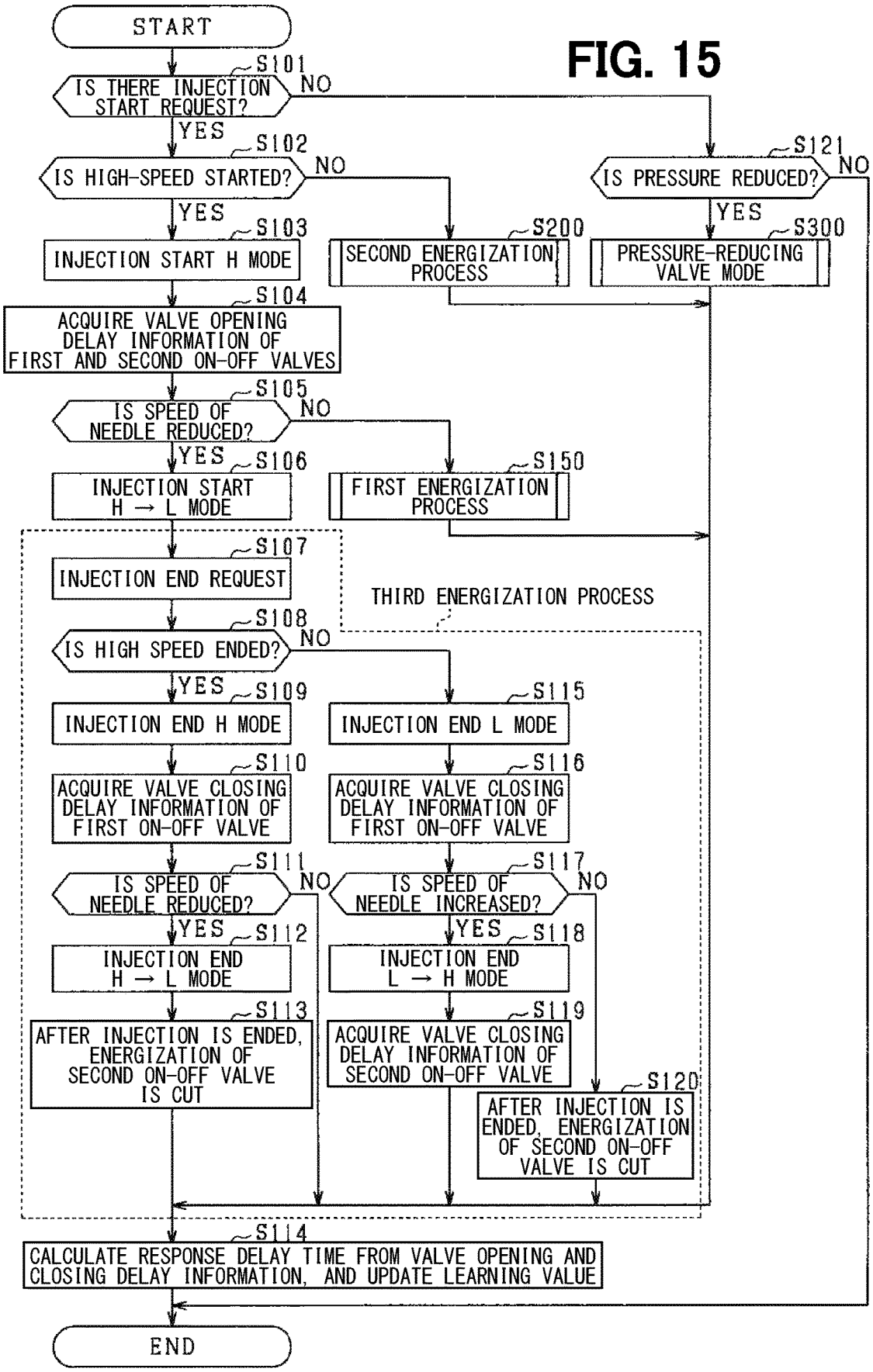
FIG. 15
START
S101
IS THERE INJECTION START REQUEST?
NO
YES
S102
IS HIGH-SPEED STARTED?
NO
YES
S103
INJECTION START H MODE
S200
SECOND ENERGIZATION PROCESS
S121
IS PRESSURE REDUCED?
NO
YES
S300
PRESSURE-REDUCING VALVE MODE
S104
ACQUIRE VALVE OPENING DELAY INFORMATION OF FIRST AND SECOND ON-OFF VALVES
S105
IS SPEED OF NEEDLE REDUCED?
NO
YES
S106
INJECTION START H → L MODE
S150
FIRST ENERGIZATION PROCESS
S107
INJECTION END REQUEST
THIRD ENERGIZATION PROCESS
S108
IS HIGH SPEED ENDED?
NO
YES
S109
INJECTION END H MODE
S115
INJECTION END L MODE
S110
ACQUIRE VALVE CLOSING DELAY INFORMATION OF FIRST ON-OFF VALVE
S116
ACQUIRE VALVE CLOSING DELAY INFORMATION OF FIRST ON-OFF VALVE
S111
IS SPEED OF NEEDLE REDUCED?
NO
YES
S112
INJECTION END H → L MODE
S117
IS SPEED OF NEEDLE INCREASED?
NO
YES
S118
INJECTION END L → H MODE
S113
AFTER INJECTION IS ENDED, ENERGIZATION OF SECOND ON-OFF VALVE IS CUT
S119
ACQUIRE VALVE CLOSING DELAY INFORMATION OF SECOND ON-OFF VALVE
S120
AFTER INJECTION IS ENDED, ENERGIZATION OF SECOND ON-OFF VALVE IS CUT
S114
CALCULATE RESPONSE DELAY TIME FROM VALVE OPENING AND CLOSING DELAY INFORMATION, AND UPDATE LEARNING VALUE
END

FUEL INJECTION SYSTEM

CROSS REFERENCE TO RELATED APPLICATION

The present application is a continuation application of International Patent Application No. PCT/JP2019/045127 filed on Nov. 18, 2019, which designated the U.S. and claims the benefit of priority from Japanese Patent Application No. 2018-216792 filed on Nov. 19, 2018. The entire disclosures of all of the above applications are incorporated herein by reference.

TECHNICAL FIELD

The present disclosure relates to a fuel injection system.

BACKGROUND

Conventionally, a fuel injection valve is provided to an internal combustion engine to inject fuel to a cylinder of the internal combustion engine.

SUMMARY

According to an example of the present disclosure, a fuel injection system includes an accumulator container configured to accumulate fuel in a high-pressure state and a fuel injection valve configured to inject high-pressure fuel in the accumulator container to a cylinder of an internal combustion engine.

BRIEF DESCRIPTION OF THE DRAWINGS

The above and other objects, features and advantages of the present disclosure will become more apparent from the following detailed description made with reference to the accompanying drawings. In the drawings:

FIG. 15 is a flowchart illustrating a processing procedure of a response delay time computation process;

DETAILED DESCRIPTION

Figure 1:
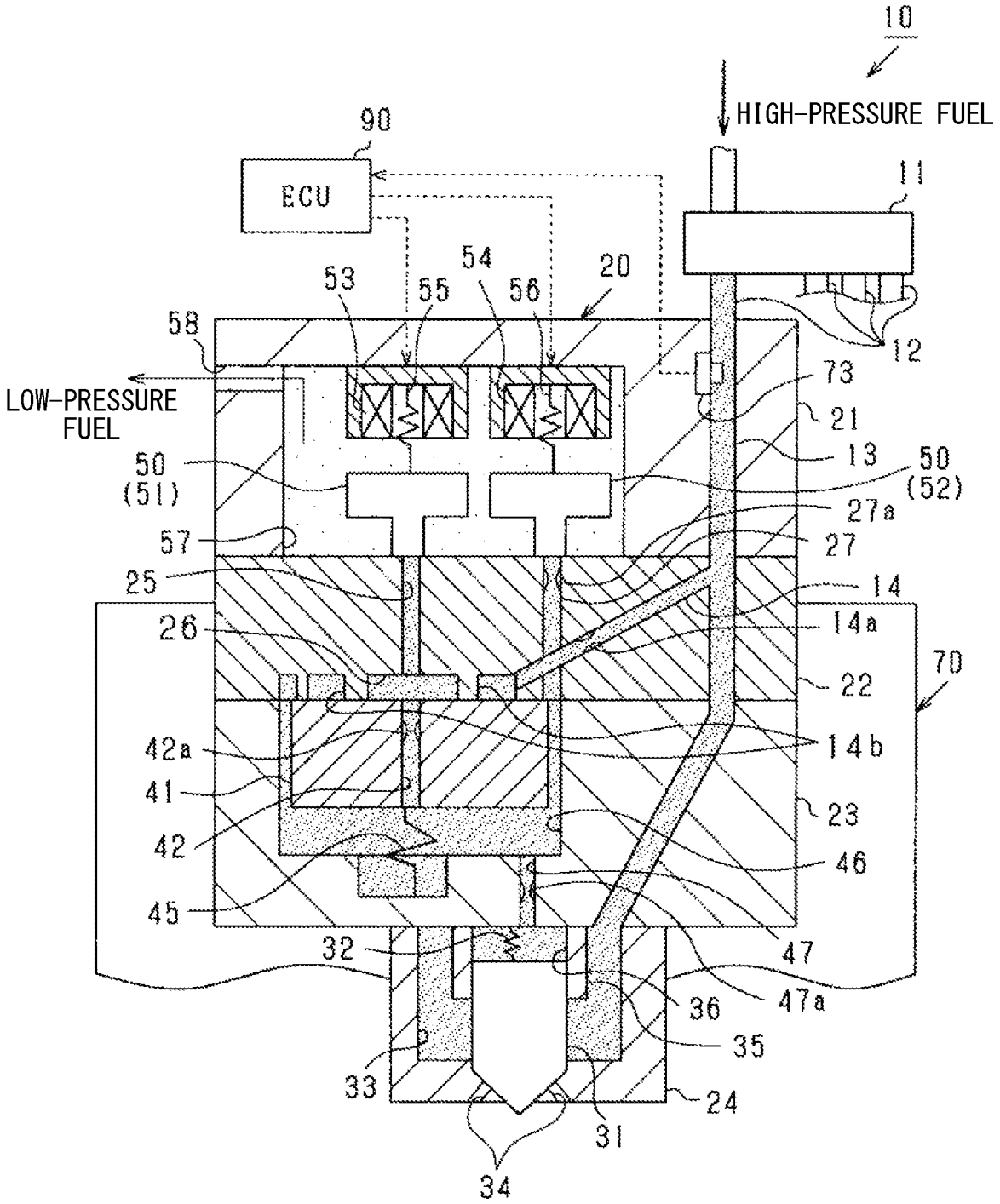
FIG. 1 is a view illustrating a schematic configuration of a fuel injection system.

Hereinafter, examples of the present disclosure will be described.

According to an example of the present disclosure, a fuel pressure sensor that detects the pressure of fuel that fluctuates according to fuel injection from an injection hole is attached to a fuel passage from an accumulator container to the injection hole of the fuel injection valve. A control device estimates an actual injection start timing and injection end timing based on a fluctuation waveform generated by fuel injection. The injection start timing and the injection end timing which are estimated in this manner, to enable to detect the response delay of the fuel injection valve with respect to an injection command signal. Thus, an injection state of fuel actually injected from a fuel injection valve is detected and a fuel injection system is controlled with high accuracy.

According to an example of the present disclosure, the fuel injection valve includes two on-off valves as pressure adjusting valves for adjusting the fuel pressure in a control chamber, and adjusts an inclination of an injection rate of the fuel injected from the injection hole by independently controlling the drive of the on-off valves. In such a fuel injection valve, when an attempt is made to detect the response delay of the fuel injection valve with respect to the injection command signal by using a detection value of the fuel pressure sensor, it may not possible to determine which of the two on-off valves causes the response delay of the pressure adjusting valve simply by estimating the injection start timing and the injection end timing. In order to realize more appropriate fuel injection control, it is required to sufficiently improve the driving accuracy of the pressure adjusting valve.

According to an aspect of the present disclosure, a fuel injection system includes an accumulator container configured to accumulate fuel in a high-pressure state, and a fuel injection valve configured to inject high-pressure fuel in the accumulator container to a cylinder of an internal combustion engine. The fuel injection valve includes a control chamber configured to be supplied with the high-pressure fuel from the accumulator container through a high-pressure fuel passage, a needle valve configured to move in an axial direction according to a fuel pressure inside the control chamber to open an injection hole to inject the fuel, and a pressure adjusting valve placed in a fuel passage connected to the control chamber and configured to allow and to shut off an outflow of the fuel from the control chamber to adjust the fuel pressure inside the control chamber. The fuel passage includes a first fuel passage having a first orifice and a second fuel passage having a second orifice that is configured to limit a flow rate of the fuel through a flow passage area different from a flow passage area of the first orifice. The pressure adjusting valve includes a first on-off valve placed in the first fuel passage and a second on-off valve placed in the second fuel passage. The system comprises a pressure detection unit configured to detect the fuel pressure in the high-pressure fuel passage; a drive control unit configured to control opening and closing of the pressure adjusting valve based on a drive command signal output to the fuel injection valve; an acquisition unit configured to acquire an inflection point of the fuel pressure detected by the pressure detection unit and an inclination of the fuel pressure after the inflection point appears, after an output of the drive command signal; and a delay time computation unit configured to compute a response delay time of the pressure adjusting valve with respect to the drive command signal for each of the first on-off valve and the second on-off valve based on the inflection point and the inclination acquired by the acquisition unit.

In the fuel injection valve having the above-described configuration, the behavior of the pressure change of the fuel pressure in the control chamber differs depending on the combination of the on-off state of the first on-off valve and the on-off state of the second on-off valve. In this case, the behavior of the pressure change of the fuel pressure in the high-pressure fuel passage connecting the accumulator container and the control chamber to each other also differs. In other words, when the first on-off valve is opened and the fuel is discharged from the first fuel passage, and when the second on-off valve is opened and the fuel is discharged from the second fuel passage, the flow rate of the fuel discharged from the control chamber is different, and according to this, the change behavior of the fuel pressure in the high-pressure fuel passage is different. By paying attention to these points and adopting the above-described configuration, it is possible to specify which on-off valve causes the response delay of the pressure adjusting valve. Accordingly, the response delay of the pressure adjusting valve can be detected accurately, and the accuracy of the fuel injection system can further be improved.

Embodiments will be described with reference to the drawings. In each of the following embodiments, parts that are the same or equal to each other will be given the same reference numerals in the drawings, and the description thereof will be incorporated for the parts having the same reference numerals.

The present embodiment is embodied in a fuel injection system applied to an in-vehicle multi-cylinder diesel engine which is an internal combustion engine. In the fuel injection system, the fuel injection of the engine is controlled by using an electronic control unit (hereinafter, referred to as "ECU") as a center. As illustrated in FIG. 1, a fuel injection system 10 includes a common rail 11, a fuel injection valve 20, and an ECU 90.

In FIG. 1, the common rail 11 is connected to the downstream side of a high-pressure pump (not illustrated), and fuel (hereinafter, referred to as "high-pressure fuel") increased in pressure by the high-pressure pump is supplied. Inside the common rail 11, the high-pressure fuel pumped from the high-pressure pump is held in a high-pressure state. The common rail 11 is not provided with a pressure-reducing valve for reducing the fuel pressure in the common rail (hereinafter, referred to as "rail pressure").

The fuel injection valve 20 is connected to the common rail 11 via a high-pressure pipe 12. The fuel injection valve 20 is a direct injection type that directly injects fuel into the combustion chamber of the engine 70, and is attached to each of multiple cylinders (four cylinders in the present embodiment). FIG. 1 illustrates only the fuel injection valve 20 of one cylinder, and the description of the fuel injection valve 20 will be omitted for the remaining cylinders.

The ECU 90 is a microcomputer including a central processing unit (CPU), a read-only memory (ROM), a random-access memory (RAM), a driving circuit, an input-output interface, and the like. Detection signals are sequentially input to the ECU 90 from various sensors such as a crank angle sensor that detects the rotation speed of the engine 70 and an accelerator sensor that detects the accelerator operation amount. The ECU 90 computes the optimum fuel injection amount and injection timing based on engine operation information such as engine rotation speed and accelerator operation amount, and outputs an energization pulse (injection signal) corresponding to the optimum fuel injection amount and injection timing to the fuel injection valve 20. Accordingly, the fuel injection of the fuel injection valve 20 is controlled in each cylinder. The ECU 90 functions as a "drive control unit", a "delay time computation unit", and an "injection correction unit".

Next, the configuration of the fuel injection valve 20 will be described in detail. The fuel injection valve 20 includes first to fourth main body portions 21 to 24, and the injection valve main body is formed of the first to fourth main body portions 21 to 24 which are integrated with each other. The first to fourth main body portions 21 to 24 are arranged in this order in the axial direction of the fuel injection valve 20, and the fuel supplied from the common rail 11 to the first main body portion 21 is injected from an injection hole 34 provided in the fourth main body portion 24. In the following description, the axial direction of the fuel injection valve 20 is referred to as "up-down direction", a side of the first main body portion 21 of the fuel injection valve 20 is referred to as "upward", and a side of the fourth main body portion 24 is referred to as "downward".

The first main body portion 21 is provided with a first high-pressure passage 13 and a low-pressure chamber 57. The first high-pressure passage 13 is formed over the first main body portion 21, the second main body portion 22, and the third main body portion 23, and penetrates the first to third main body portions 21 to 23. The end portion of the first high-pressure passage 13 opposite to the side of the second main body portion 22 communicates with the high-pressure pipe 12. Accordingly, the high-pressure fuel from the common rail 11 is supplied to the first high-pressure passage 13 via the high-pressure pipe 12. A fuel pressure sensor 73 for detecting the pressure of fuel in the first high-pressure passage 13 is attached to the first high-pressure passage 13. The detection signal of the fuel pressure sensor 73 is input to the ECU 90.

The low-pressure chamber 57 is formed at the boundary portion between the first main body portion 21 and the second main body portion 22 by the surface facing the second main body portion 22 being recessed upward. In the low-pressure chamber 57, the high-pressure fuel in the first high-pressure passage 13 passes through the second main body portion 22, the third main body portion 23, and the fourth main body portion 24, and accordingly, the fuel of which the pressure is reduced is stored. The low-pressure chamber 57 is connected to a return pipe 65 via a low-pressure passage 58, and is further connected to a fuel tank 61. Accordingly, a part of the high-pressure fuel supplied to the fuel injection valve 20 is returned from the low-pressure chamber 57 to the fuel tank 61 through the return pipe 65. Inside the low-pressure chamber 57, an on-off valve 50 for controlling the fuel injection state of the fuel injection valve 20 is provided. The on-off valve 50 is an electromagnetically driven type, and valve opening and closing are controlled by the ECU 90.

The second main body portion 22 is provided with a second high-pressure passage 14, an intermediate chamber 26, a first passage 25, and a second passage 27. The second high-pressure passage 14 is a branch passage branching from the first high-pressure passage 13, and is a fuel passage to which the high-pressure fuel is supplied from the common rail 11. The second high-pressure passage 14 is provided with a boosting orifice 14*a*. The boosting orifice 14*a* limits the flow rate of fuel flowing through the second high-pressure passage 14. In the second high-pressure passage 14, an annular chamber 14*b* is formed at an end portion opposite to the first high-pressure passage 13. The annular chamber 14*b* is a fuel passage unit formed in an annular shape at the boundary portion between the second main body portion 22 and the third main body portion 23. The high-pressure fuel from the first high-pressure passage 13 is introduced into the annular chamber 14*b* through the second high-pressure passage 14.

The intermediate chamber 26 is a columnar chamber, which is formed at the boundary portion between the second main body portion 22 and the third main body portion 23. The first passage 25 extends in the axial direction (up-down direction) of the fuel injection valve 20 inside the second main body portion 22 and penetrates the second main body portion 22. One end portion of the first passage 25 communicates with the low-pressure chamber 57, and the other end portion communicates with the intermediate chamber 26. Accordingly, the intermediate chamber 26 communicates with the low-pressure chamber 57 via the first passage 25.

The second passage 27 is formed inside the second main body portion 22 and extends in the same direction (up-down direction) as the first passage 25. The second passage 27 penetrates the second main body portion 22, one end portion thereof communicates with the low-pressure chamber 57, and the other end portion thereof communicates with a first control chamber 46 of the third main body portion 23. The second passage 27 is provided with a pressure-reducing orifice 27*a* at a position close to the first main body portion 21. The pressure-reducing orifice 27*a* limits the flow rate of fuel flowing through the second passage 27. The second passage 27 corresponds to the "second fuel passage", and the pressure-reducing orifice 27*a* corresponds to the "second orifice".

The third main body portion 23 is provided with the first control chamber 46 and a connecting passage 47. The first control chamber 46 is a chamber formed inside the injection valve main body by the surface facing the second main body portion 22 being recessed downward, and communicates with the annular chamber 14*b*. The high-pressure fuel from the first high-pressure passage 13 is supplied to the first control chamber 46 via the second high-pressure passage 14.

Inside the first control chamber 46, a driven valve 41 that can be displaced in the axial direction (up-down direction) of the fuel injection valve 20 is arranged. The driven valve 41 has a columnar shape, and a third passage 42 penetrating in the axial direction is formed at the center portion thereof. In the third passage 42, the opening portion on the side of the second main body portion 22 is open to the intermediate chamber 26, and the opening portion on the side of the fourth main body portion 24 is open to the inside of the first control chamber 46. A pressure-reducing orifice 42*a* is provided in the third passage 42. The pressure-reducing orifice 42*a* limits the flow rate of fuel flowing through the third passage 42. The fuel flow rate on the outlet side of the pressure-reducing orifice 42*a* is set to be larger than the fuel flow rate on the outlet side of the pressure-reducing orifice 27*a* included in the second passage 27. The "first fuel passage" includes the first passage 25 and the third passage 42. The pressure-reducing orifice 42*a* corresponds to the "first orifice".

A spring 45 that urges the driven valve 41 in the direction toward the second main body portion 22 (upward) is attached to the driven valve 41. The driven valve 41 is in contact with the lower surface of the second main body portion 22 due to the upward force caused by the fuel pressure inside the first control chamber 46 and the urging force of the spring 45. In this contact state, while the driven valve 41 shuts off the communication between the annular chamber 14*b* and the first control chamber 46, the intermediate chamber 26 communicates with the first control chamber 46 via the third passage 42. In this state, the fuel in the first control chamber 46 can flow into the low-pressure chamber 57 via the third passage 42, the intermediate chamber 26, and the first passage 25.

In a state where the driven valve 41 is in contact with the lower surface of the second main body portion 22, when the fuel pressure inside the first control chamber 46 drops, and the upward force due to the fuel pressure inside the first control chamber 46 and the urging force of the spring 45 falls below the downward force due to the fuel pressure inside the annular chamber 14*b* and the intermediate chamber 26, the driven valve 41 is displaced in a direction of separating from the lower surface of the second main body portion 22. Accordingly, the intermediate chamber 26 communicates with the first control chamber 46 without passing through the third passage 42, and the annular chamber 14*b* communicates with the first control chamber 46.

The second passage 27 directly communicates with the low-pressure chamber 57 and the first control chamber 46. In other words, the first control chamber 46 communicates with the low-pressure chamber 57 via the second passage 27 regardless of the position (lift state) of the driven valve 41. The third main body portion 23 includes the connecting passage 47 extending from the first control chamber 46 to the fourth main body portion 24. The connecting passage 47 is provided with an orifice 47*a*, and the orifice 47*a* limits the flow rate of fuel flowing through the connecting passage 47.

The fourth main body portion 24 is provided with a cylinder 35, a needle valve 31, a high-pressure chamber 33, and a second control chamber 36. Multiple injection holes 34 for injecting the fuel toward the outside are formed at the tip portion of the cylinder 35. The needle valve 31 is stored inside the cylinder 35 so as to be reciprocating in the up-down direction. A spring 32 that urges the needle valve 31 downward is attached to the upper surface of the needle valve 31.

The high-pressure chamber 33 is provided on the way to the passage that makes the first high-pressure passage 13 and the injection hole 34 communicate with each other. The tip portion of the needle valve 31 is placed inside the high-pressure chamber 33. The second control chamber 36 is provided inside the cylinder 35 on the side opposite to the injection hole 34 (above the needle valve 31). The second control chamber 36 communicates with the first control chamber 46 via the connecting passage 47. Accordingly, the high-pressure fuel from the first high-pressure passage 13 is supplied to the second control chamber 36 via the first control chamber 46 and the connecting passage 47. The fuel pressure inside the second control chamber 36 and the urging force of the spring 32 attached to the needle valve 31 act on the needle valve 31, and accordingly, the needle valve 31 is displaced in a direction (downward) in which the injection hole 34 is blocked, and the fuel injection valve 20 is in a valve-closed state.

When the fuel pressure inside the high-pressure chamber 33 becomes larger than the total force of the fuel pressure inside the second control chamber 36 and the urging force of the spring 32, the needle valve 31 is displaced in a direction (upward) in which the injection hole 34 is opened, and the valve-open state of the fuel injection valve 20 is achieved. When the valve-open state of the fuel injection valve 20 is achieved, the high-pressure fuel in the high-pressure chamber 33 is injected from the injection hole 34.

Next, the configuration of the on-off valve 50 will be described. The on-off valve 50 is placed inside the low-pressure chamber 57 in a fuel passage connecting the first control chamber 46 and the low-pressure chamber 57 to each other. The on-off valve 50 adjusts the fuel pressure inside the first control chamber 46 by allowing and shutting off the outflow of fuel from the first control chamber 46 to the low-pressure chamber 57 by drive control by the ECU 90.

The on-off valve 50 includes a first on-off valve 51 and a second on-off valve 52. The first on-off valve 51 is placed on the first passage 25, and the communication and shut off between the low-pressure chamber 57 and the first passage 25 are switched by controlling the on-off state thereof. The second on-off valve 52 is placed on the second passage 27, and the communication and shut off between the low-pressure chamber 57 and the second passage 27 are switched by controlling the on-off state thereof. The ECU 90 controls the on-off state of the first on-off valve 51 and the on-off state of the second on-off valve 52 independently of each other, by energizing and driving a first solenoid 53 and a second solenoid 54 independently of each other.

Specifically, when the first solenoid 53 is not energized, the first on-off valve 51 is in contact with the second main body portion 22 by the urging force of a first spring 55. In this contact state, the first on-off valve 51 shuts off the communication between the low-pressure chamber 57 and the first passage 25 (valve-closed state). When the first solenoid 53 is energized in the valve-closed state of the first on-off valve 51, the first on-off valve 51 moves upward against the urging force of the first spring 55 and is separated from the second main body portion 22. In this state, the low-pressure chamber 57 and the first passage 25 are in communicating state (valve-open state), and the inflow of fuel from the first passage 25 into the low-pressure chamber 57 is allowed.

When the second solenoid 54 is not energized, the second on-off valve 52 is in contact with the second main body portion 22 by the urging force of a second spring 56. In this contact state, the second on-off valve 52 shuts off the communication between the low-pressure chamber 57 and the second passage 27 (valve-closed state). When the second solenoid 54 is energized in the valve-closed state of the second on-off valve 52, the second on-off valve 52 moves upward against the urging force of the second spring 56 and is separated from the second main body portion 22. In this state, the low-pressure chamber 57 and the second passage 27 are in communicating state (valve-open state), and the inflow of fuel from the second passage 27 into the low-pressure chamber 57 is allowed.

In fuel injection control, the ECU 90 moves the needle valve 31 to the valve opening position and the valve closing position by switching the opening and closing of the first on-off valve 51. Accordingly, the injection operation in which the fuel is injected from the injection hole 34 and the injection stop operation in which the fuel injection is stopped are switched. The ECU 90 controls movement speed when the needle valve 31 moves to the valve opening position and the valve closing position by switching the opening and closing of the second on-off valve 52 in accordance with the drive control of the first on-off valve 51. In other words, by independently controlling the opening and closing of the first on-off valve 51 and the second on-off valve 52, the ECU 90 controls the inclination of the fuel injection rate, more specifically, each of the rising speed and the falling speed of the injection rate.

Figure 2:
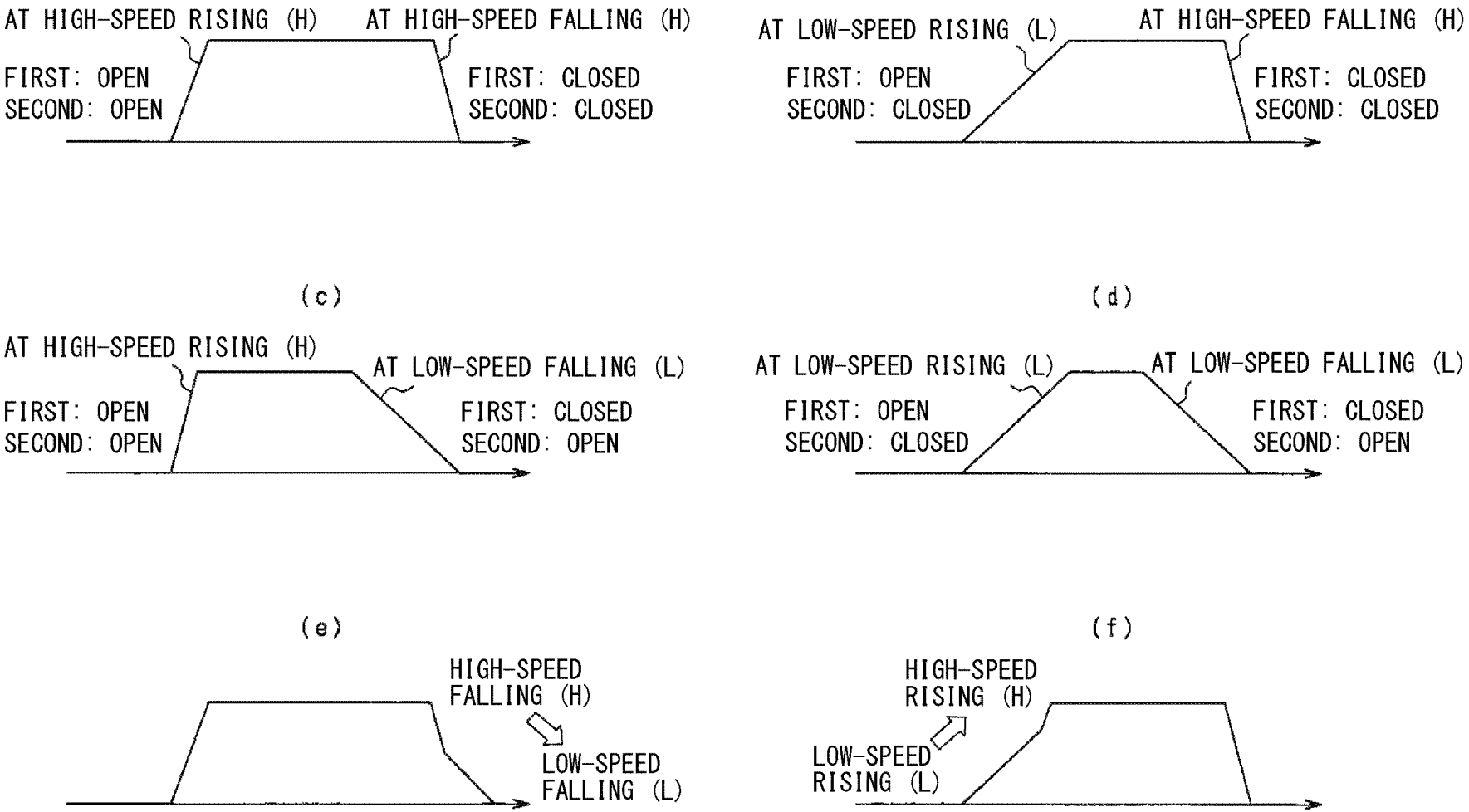
FIG. 2 is a view illustrating an example of an injection rate pattern of a fuel injection valve.

FIG. 2 illustrates an example of an injection rate pattern of the fuel injection valve 20. In any of the injection rate patterns, the first on-off valve 51 is opened at the start of fuel injection by the fuel injection valve 20, and the first on-off valve 51 is closed at the end of fuel injection. With respect to the second on-off valve 52, the valve opening and closing are controlled according to the rising speed and the falling speed of the injection rate.

Specifically, in the high-speed valve opening mode (injection start (H) mode) in which the rising speed of the injection rate at the start of fuel injection is steep, the second on-off valve 52 is opened (refer to (a) and (c) in FIG. 2), and in the low-speed valve opening mode (injection start (L) mode) in which the rising speed of the injection rate is slowed down, the second on-off valve 52 is closed (refer to (b) and (d) in FIG. 2). In the high-speed valve closing mode (injection end (H) mode) in which the falling speed of the injection rate at the end of fuel injection is steep, the second on-off valve 52 is closed (refer to (a) and (b) in FIG. 2), and in the low-speed valve closing mode (injection end (L) mode) in which the falling speed of the injection rate is slowed down, the second on-off valve 52 is opened (refer to (c) and (d) in FIG. 2). The rising speed and the falling speed of the injection rate may be changed in the middle. According to the fuel injection valve 20, for example, as illustrated in (e) in FIG. 2, an injection rate pattern (injection end (H→L) mode) for changing from the high-speed valve closing mode to the low-speed valve closing mode can be realized, and as illustrated in 2(f), it is also possible to realize the injection rate pattern (injection start (L→H) mode) for changing from the low-speed valve opening mode to the high-speed valve opening mode.

Figure 3:
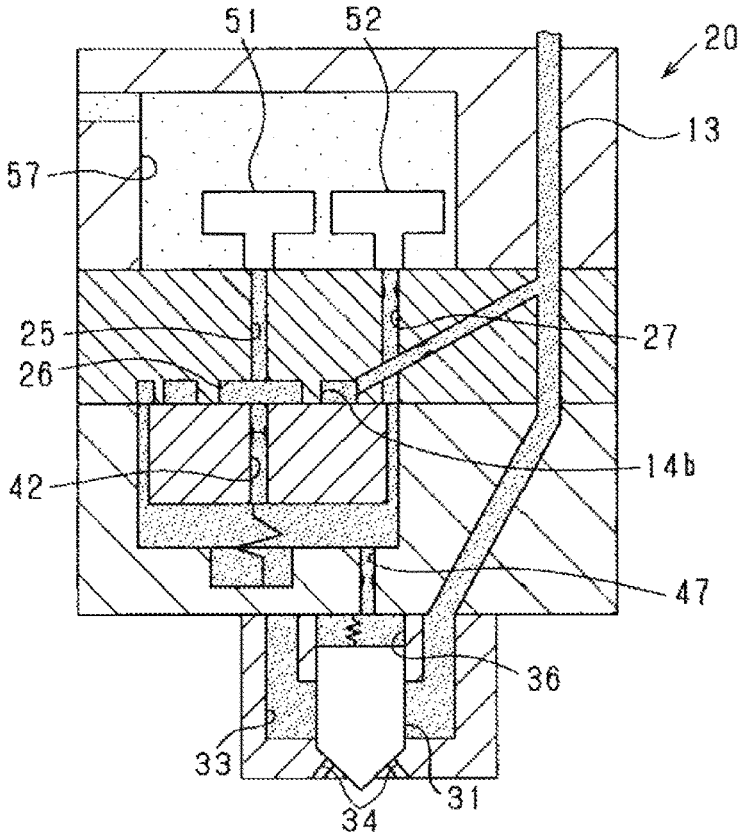
FIG. 3 is a view illustrating the fuel injection valve when the valve is closed.

The relationship between the on-off state of the first on-off valve 51 and the second on-off valve 52 and the operation of the fuel injection valve 20 will be described with reference to FIGS. 3 to 8. Before the start of injection, the first solenoid 53 and the second solenoid 54 are not energized, and accordingly, as illustrated in FIG. 3, both the first on-off valve 51 and the second on-off valve 52 are closed, and the communication between the high-pressure chamber 33 and the injection hole 34 is shut off by the needle valve 31.

A case of the injection pattern of the high-speed valve opening mode and the high-speed valve closing mode (refer to (a) in FIG. 2) will be described with reference to FIGS. 3 to 6. Before the start of injection, in a state where the first on-off valve 51 and the second on-off valve 52 are closed, the high-pressure fuel is introduced from the first high-pressure passage 13, and accordingly, a fuel storage unit (annular chamber 14*b*, intermediate chamber 26, first control chamber 46, second control chamber 36, high-pressure chamber 33) and a fuel passage (first passage 25, second passage 27, third passage 42, connecting passage 47), which are provided in the second to fourth main body portions 22 to 24, are held in a high-pressure state equivalent to the fuel pressure in the first high-pressure passage 13 (refer to FIG. 3).

Figure 4:
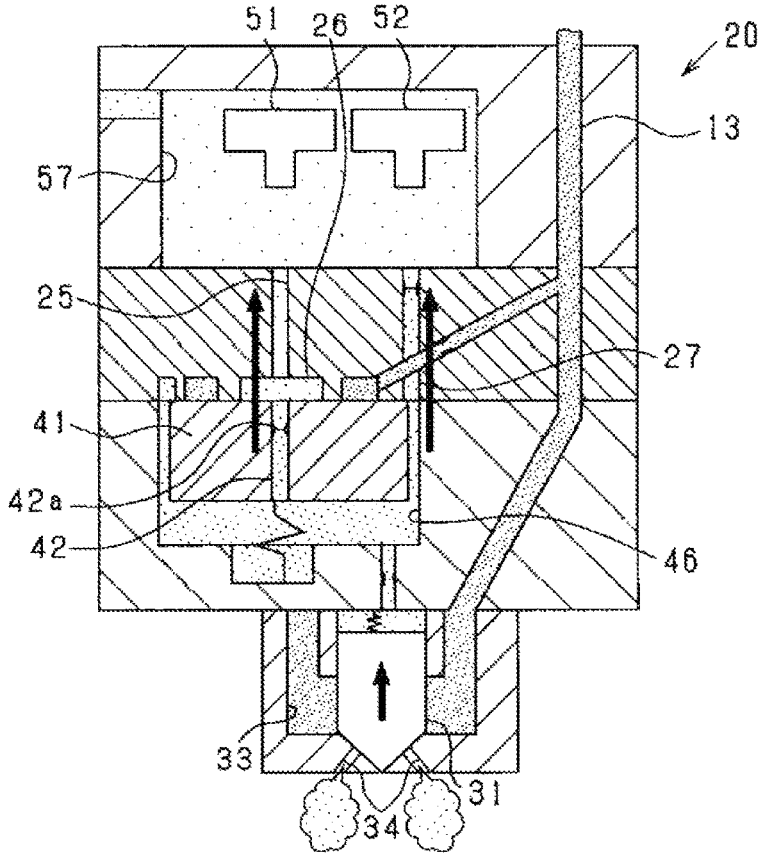
FIG. 4 is a view describing an operation of the fuel injection valve in a high-speed valve opening mode.

In a state where the first on-off valve 51 and the second on-off valve 52 are closed, when both the first on-off valve 51 and the second on-off valve 52 are opened by energizing the first solenoid 53 and the second solenoid 54, as illustrated in FIG. 4, the first control chamber 46 communicates with the low-pressure chamber 57 via the first passage 25, the third passage 42, and the second passage 27. Accordingly, the fuel inside the first control chamber 46 and the second control chamber 36 flows into the low-pressure chamber 57 via two passages, such as a passage passing through the first passage 25 and the third passage 42, and a passage passing through the second passage 27. Therefore, the fuel pressure inside the first control chamber 46 and the second control chamber 36 drops at high speed, and the needle valve 31 is displaced at high speed in the valve opening direction (upward). Accordingly, the fuel is injected from the injection hole 34. In this case, as illustrated in (a) in FIG. 2, the injection rate rises at a high speed.

A differential pressure is generated before and after the pressure-reducing orifice 42*a*, and the total of the upward force due to the fuel pressure inside the first control chamber 46 and the urging force of the spring 45 is higher than the downward force due to the fuel pressure inside the intermediate chamber 26 and the annular chamber 14*b*. Therefore, the driven valve 41 is maintained in a state of being in contact with the second main body portion 22 in a state where both the first on-off valve 51 and the second on-off valve 52 are open (refer to FIG. 4).

Figure 5:
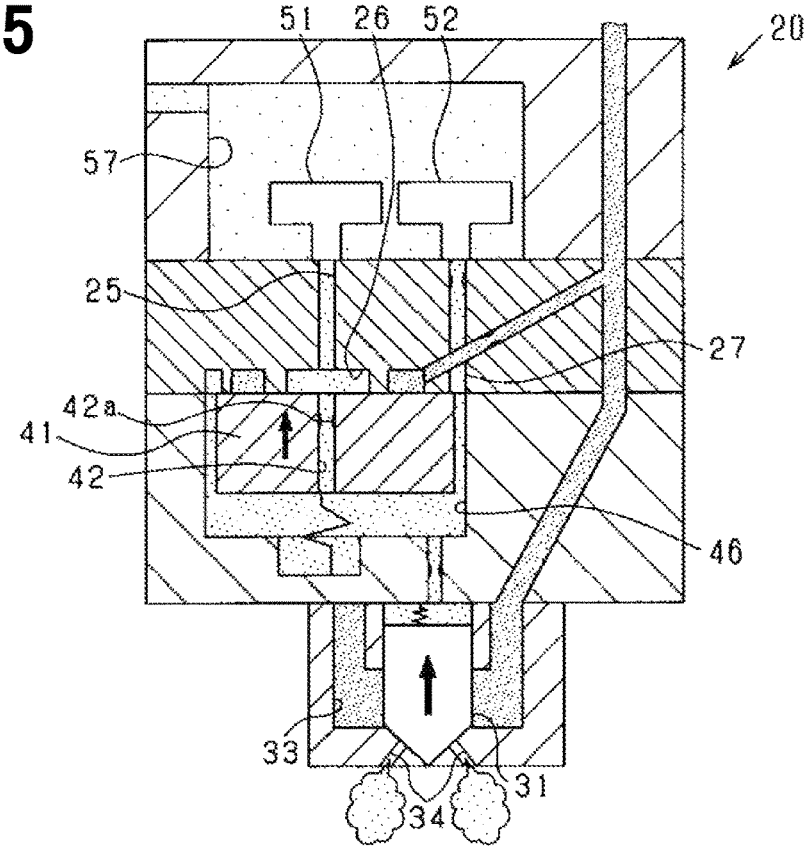
FIG. 5 is a view describing an operation of the fuel injection valve when shifting from the high-speed valve opening mode to a high-speed valve closing mode.
Figure 6:
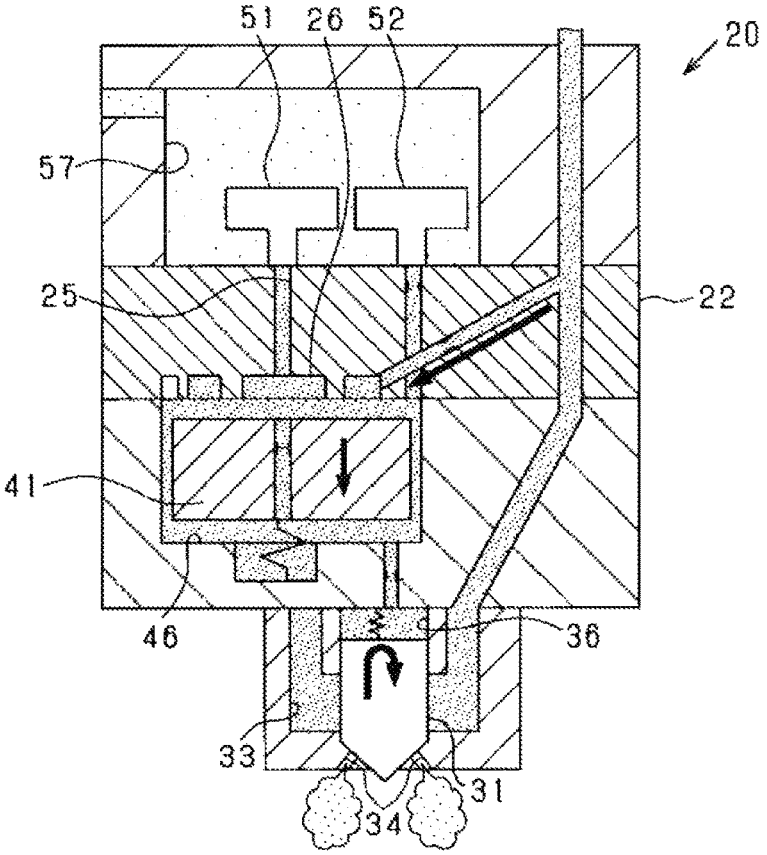
FIG. 6 is a view describing an operation of the fuel injection valve in the high-speed valve closing mode.

When the first on-off valve 51 is closed after the injection rate is maximized, the fuel in the first control chamber 46 flows into the intermediate chamber 26 through the third passage 42, and accordingly, the fuel pressure inside the intermediate chamber 26 rises (refer to FIG. 5). By closing the second on-off valve 52, the communication between the low-pressure chamber 57 and the first control chamber 46 is shut off. In this case, the downward force due to the fuel pressure inside the intermediate chamber 26 and the annular chamber 14*b* becomes larger than the total of the upward force due to the fuel pressure inside the first control chamber 46 and the urging force of the spring 45, and accordingly, the driven valve 41 moves downward (refer to FIG. 6). Due to the downward movement of the driven valve 41, the high-pressure fuel in the first high-pressure passage 13 flows into the first control chamber 46.

At this time, since both the first on-off valve 51 and the second on-off valve 52 are closed, the fuel pressure inside the first control chamber 46 rises at a high speed. When the fuel flows from the first control chamber 46 into the second control chamber 36 through the connecting passage 47 and the fuel pressure inside the second control chamber 36 becomes higher than a predetermined pressure, the needle valve 31 starts to descend and shifts to the valve closing operation (refer to FIG. 6). In this case, as illustrated in (a) in FIG. 2, the injection rate falls at a high speed. After this, the injection hole 34 is blocked by the needle valve 31, and accordingly, the fuel injection by the fuel injection valve 20 is stopped.

Figure 7:
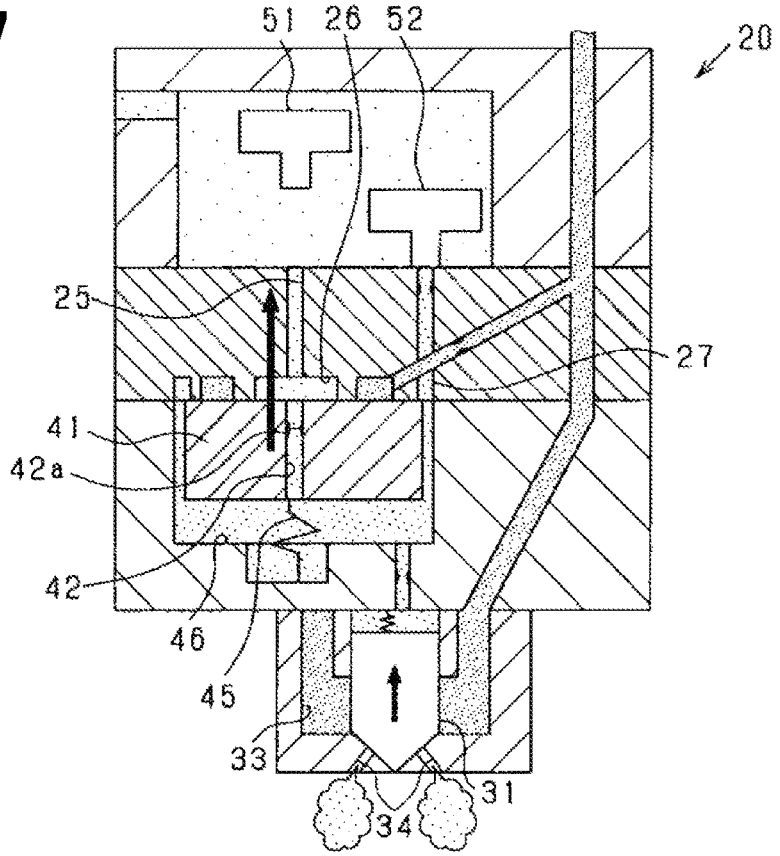
FIG. 7 is a view describing an operation of the fuel injection valve in a low-speed valve opening mode.

Next, a case of the injection pattern of the low-speed valve opening mode and the high-speed valve closing mode (refer to (b) in FIG. 2) will be described. Before the start of injection, in a state where the first on-off valve 51 and the second on-off valve 52 are closed (refer to FIG. 3), as illustrated in FIG. 7, the second on-off valve 52 is maintained in the closed state, and when the first on-off valve 51 is opened, the fuel inside the first control chamber 46 flows into the intermediate chamber 26 via the third passage 42 and the first passage 25. At this time, a differential pressure is generated before and after the pressure-reducing orifice 42*a*, and the total of the upward force due to the fuel pressure inside the first control chamber 46 and the urging force of the spring 45 is higher than the downward force due to the fuel pressure inside the intermediate chamber 26 and the annular chamber 14*b*. Therefore, the driven valve 41 is maintained in a state of being in contact with the second main body portion 22.

In a state where the second on-off valve 52 is closed, the flow of fuel through the second passage 27 is not allowed, and thus, the fuel pressure inside the first control chamber 46 drops at a low speed, and the needle valve 31 is displaced in the valve opening direction at a low speed. In this case, as illustrated in (b) in FIG. 2, the injection rate rises at a low speed. In other words, the rising speed (inclination) of the injection rate in a state where the first on-off valve 51 is open and the second on-off valve 52 is closed is lower than the rising speed (inclination) of the injection rate in a state where both the first on-off valve 51 and the second on-off valve 52 are open. After the injection rate is maximized, the operation is the same as that at the time of high-speed falling illustrated in (a) in FIG. 2.

Figure 8:
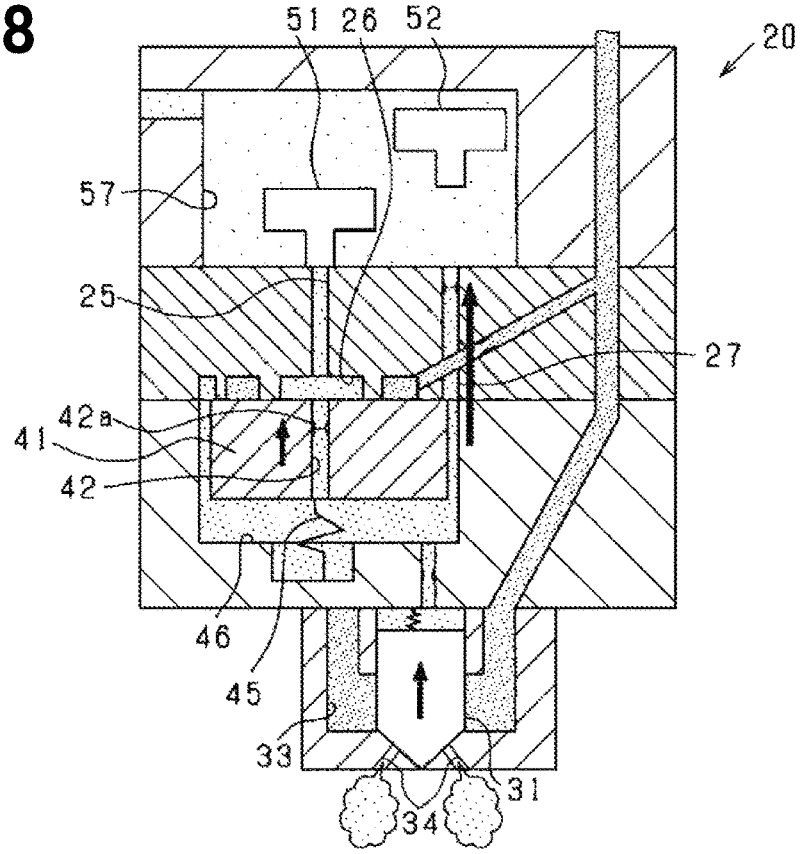
FIG. 8 is a view describing an operation of the fuel injection valve when shifting from the low-speed valve opening mode to a low-speed valve closing mode.
Figure 9:
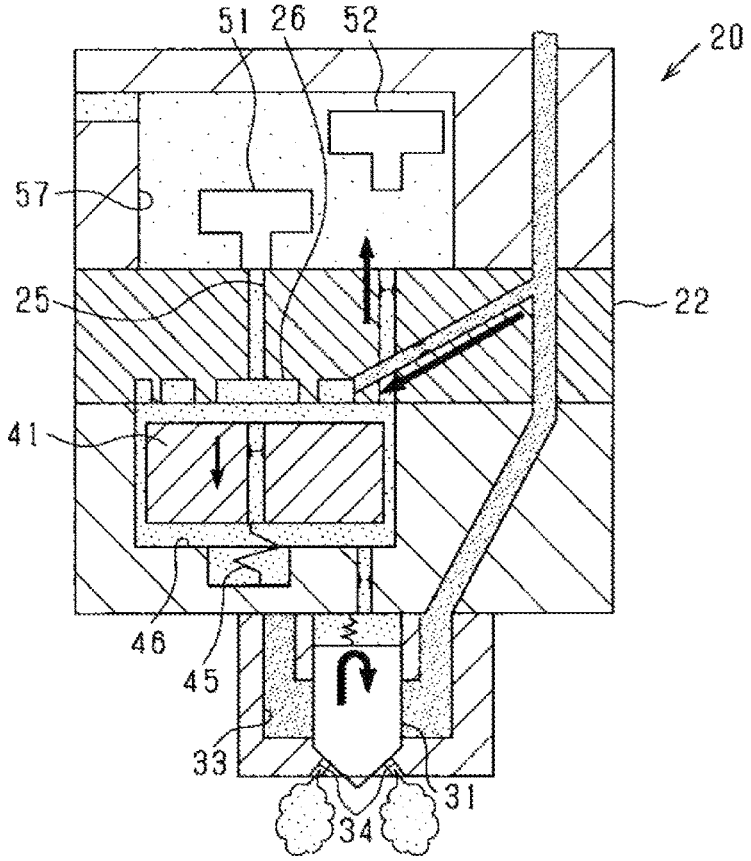
FIG. 9 is a view describing an operation of the fuel injection valve in the low-speed valve closing mode.

Next, a case of the injection pattern of the high-speed valve opening mode and the low-speed valve closing mode (refer to (c) in FIG. 2) will be described. First, the operation at high-speed rising is the same as the operation at high-speed rising illustrated in (a) in FIG. 2. After the injection rate is maximized, as illustrated in FIG. 8, a state where the second on-off valve 52 is open is maintained, and when the first on-off valve 51 is closed, the fuel in the first control chamber 46 flows into the intermediate chamber 26 through the third passage 42, and the fuel pressure inside the intermediate chamber 26 rises. Since the second on-off valve 52 is in the open state, the fuel inside the first control chamber 46 flows into the low-pressure chamber 57 via the second passage 27. When the fuel pressure inside the intermediate chamber 26 rises and the downward force due to the fuel pressure inside the intermediate chamber 26 and the annular chamber 14*b* becomes larger than the total of the upward force due to the fuel pressure inside the first control chamber 46 and the urging force of the spring 45, the driven valve 41 moves downward (refer to FIG. 9). Due to the downward movement of the driven valve 41, the high-pressure fuel in the first high-pressure passage 13 flows into the first control chamber 46.

At this time, since the second on-off valve 52 is maintained in the open state, the fuel pressure inside the first control chamber 46 rises at a low speed. When the fuel flows from the first control chamber 46 into the second control chamber 36 through the connecting passage 47 and the fuel pressure inside the second control chamber 36 becomes higher than a predetermined pressure, the needle valve 31 starts to descend and shifts to the valve closing operation (refer to FIG. 9). In this case, as illustrated in (c) in FIG. 2, the injection rate falls at a low speed. In other words, the falling speed (inclination) of the injection rate in a state where the first on-off valve 51 is closed and the second on-off valve 52 is open is lower than the falling speed (inclination) of the injection rate in a state where both the first on-off valve 51 and the second on-off valve 52 are closed. After this, the injection hole 34 is blocked by the needle valve 31, and accordingly, the fuel is not injected from the injection hole 34.

Figure 10:
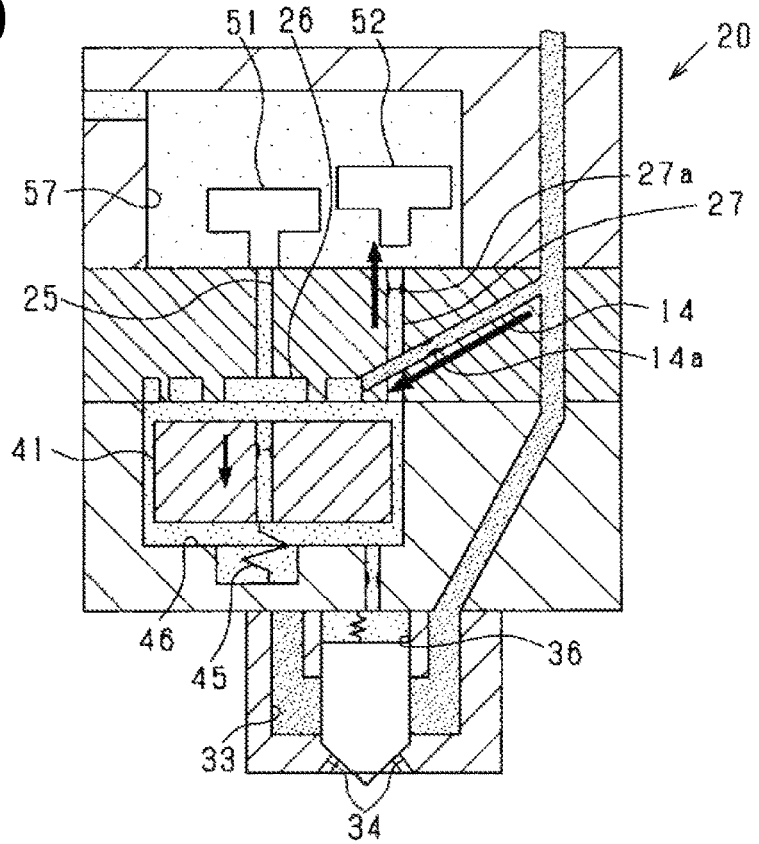
FIG. 10 is a view illustrating a pressure reducing operation by a second on-off valve.

FIG. 10 is a view illustrating the operation of the pressure-reducing valve mode in which the fuel pressure in the common rail 11 is reduced without injecting the fuel from the fuel injection valve 20 by the second on-off valve 52.

As described above, in a state where both the first on-off valve 51 and the second on-off valve 52 are closed, the fuel pressure inside the second control chamber 36, the first control chamber 46, and the intermediate chamber 26 is equivalent to the fuel pressure inside the first high-pressure passage 13, and the driven valve 41 is in contact with the second main body portion 22 (refer to FIG. 3). In the pressure reducing operation, the second on-off valve 52 is opened from this state. Accordingly, as illustrated in FIG. 10, the fuel in the first control chamber 46 is discharged to the low-pressure chamber 57 through the second passage 27, and the driven valve 41 moves downward according to the pressure drop inside the first control chamber 46.

In the fuel injection valve 20, in a state where the first on-off valve 51 is closed and the second on-off valve 52 is open, the flow rate of fuel through the boosting orifice 14*a* is set to be higher than the flow rate of fuel through the pressure-reducing orifice 27*a*. Therefore, in a state where the first on-off valve 51 is closed and the second on-off valve 52 is open, the pressure loss in the second passage 27 of the fuel discharged from the inside of the first control chamber 46 through the second passage 27 is larger than the pressure loss in the second high-pressure passage 14 of the fuel flowing into the first control chamber 46 from the second high-pressure passage 14. Therefore, in a state where the first on-off valve 51 is closed and the second on-off valve 52 is open, a state where the high-pressure chamber 33 and the injection hole 34 are shut off by the needle valve 31, that is, a state where the fuel is not injected from the injection hole 34, is maintained.

The fuel flows from the common rail 11 into the first control chamber 46 via the first high-pressure passage 13 and the second high-pressure passage 14, and the inflowing fuel is discharged from the first control chamber 46 to the low-pressure chamber 57 to return to the upstream side (low pressure side) of the fuel injection system, the fuel pressure inside the common rail 11 decreases. In other words, in a state where the fuel is not injected from the fuel injection valve 20, the fuel pressure in the common rail 11 is reduced. Therefore, the fuel injection valve 20 has a function as a pressure-reducing valve for reducing the fuel pressure in the common rail 11.

In the fuel injection valve 20, when the first passage 25 and the low-pressure chamber 57 communicate with each other by the first on-off valve 51, the flow passage area of the pressure-reducing orifice 42*a*, the opening area on the side of the third main body portion 23 (first control chamber 46) of the intermediate chamber 26, the opening area on the side of the third main body portion 23 (first control chamber 46) of the annular chamber 14*b*, and the urging force by the spring 45 are set such that the communication between the annular chamber 14*b* and the first control chamber 46 is shut off by the driven valve 41. In other words, when the first passage 25 and the low-pressure chamber 57 communicate with each other by the first on-off valve 51, a state where the first control chamber 46 and the intermediate chamber 26 communicate with each other via the third passage 42 by the driven valve 41 is achieved. This is achieved by limitation of the fuel flow rate by the pressure-reducing orifice 42*a*, the exposed area of the driven valve 41 to the intermediate chamber 26, the exposed area of the driven valve 41 to the first high-pressure passage 13, and the setting of the urging force by the spring 45.

Here, in the fuel injection valve 20, a fuel flow rate Q1 discharged from the first control chamber 46 to the low-pressure chamber 57 via the pressure-reducing orifice 42*a* according to the opening of the first on-off valve 51, and a fuel flow rate Q2 discharged from the first control chamber 46 to the low-pressure chamber 57 through the pressure-reducing orifice 27*a* according to the opening of the second on-off valve 52, are different from each other. Specifically, the fuel flow rate Q2 is smaller than the fuel flow rate Q1. Therefore, in a state where the first control chamber 46 communicates with the low-pressure chamber 57 via the pressure-reducing orifice 42*a* (that is, in a state where the driven valve 41 is in contact with the second main body portion 22), and regarding the first on-off valve 51 and the second on-off valves 52, in a state where the first on-off valve 51 is open and the second on-off valve 52 is closed, and a state where the second on-off valve 52 is open and the first on-off valve 51 is closed, the behavior of changing the fuel pressure inside the first control chamber 46 is different. The behavior of changing the fuel pressure appears as a difference in the movement speed of the needle valve 31, and further appears as a pressure change of the fuel in the high-pressure fuel passage.

Taking advantage of this point, in the present embodiment, regarding the first on-off valve 51 and the second on-off valve 52, the time (valve opening delay time Td) until the valves are actually opened according to the output of the drive command signal, and the time (valve closing delay time Te) until the valves are actually closed are computed separately for the first on-off valve 51 and the second on-off valve 52. Hereinafter, a detailed description thereof will be given with reference to FIGS. 11 and 12.

Figure 11:
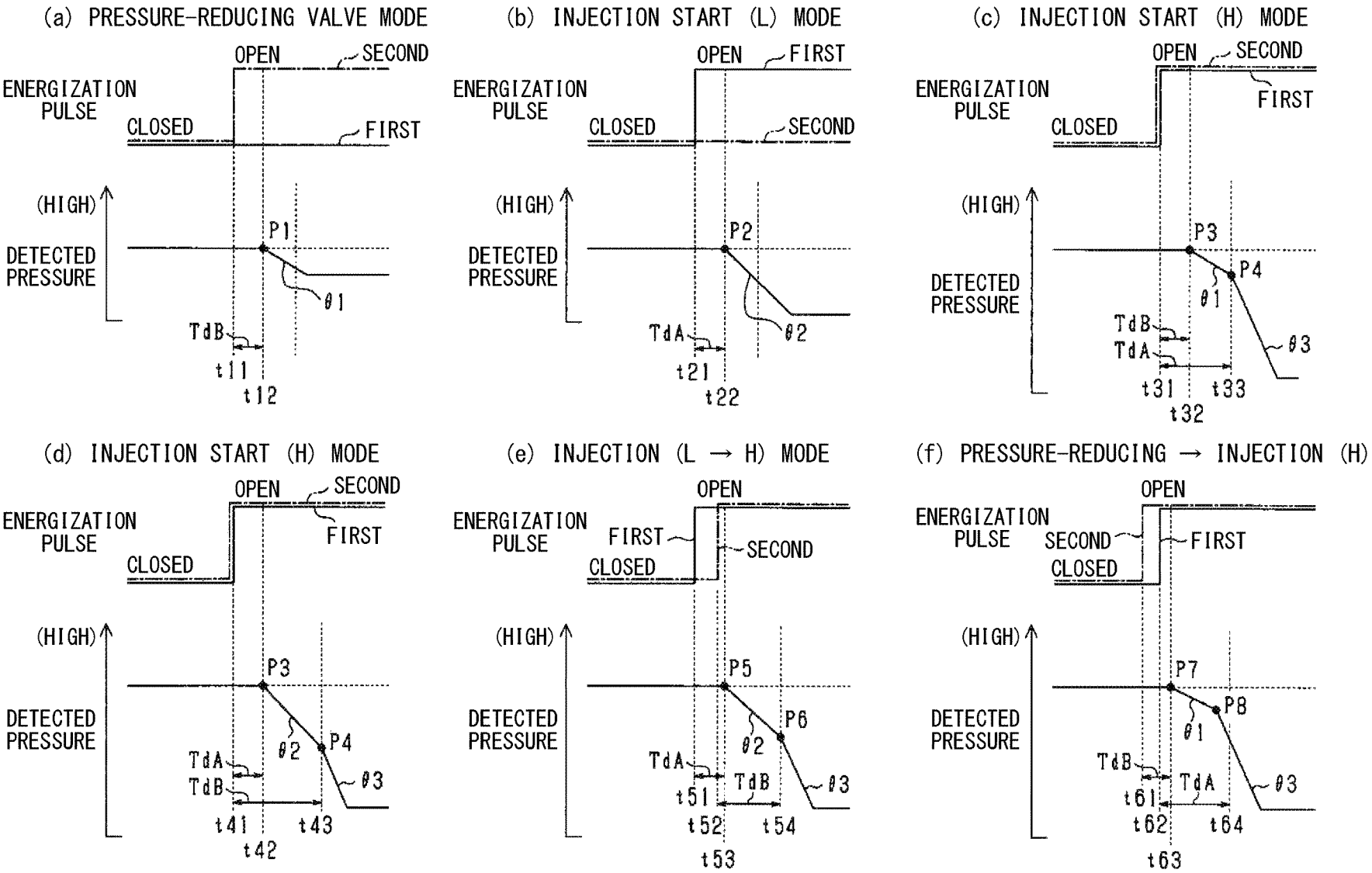
FIG. 11 is a view describing a process of computing a valve opening delay time.

FIG. 11 is a view describing a process of computing the valve opening delay time Td. FIG. 11 illustrates an example of the acquisition mode of the valve opening delay time Td in the pressure-reducing valve mode and each injection rate mode. In (a) to (f) in FIG. 11, the upper part illustrates the transition of the energization pulse of the on-off valve 50, and here, the solid line illustrates the first on-off valve 51 and the one-dot chain line illustrates the second on-off valve 52, respectively. The lower part illustrates the transition of the fuel pressure (hereinafter, referred to as "detected pressure R") in the high-pressure fuel passage. Regarding the detected pressure R, FIG. 11 illustrates a value acquired by linearly approximating the output value of the fuel pressure sensor 73 by the least squares method.

(1-1) Pressure-Reducing Valve Mode

In the pressure-reducing valve mode, as illustrated in (a) in FIG. 11, in a state where the first on-off valve 51 and the second on-off valve 52 are closed, the second solenoid 54 is energized while the first solenoid 53 is not energized (time t11). When the second on-off valve 52 is opened by this energization, the fuel in the first control chamber 46 is discharged to the low-pressure chamber 57 via the second passage 27. However, the needle valve 31 remains at the valve closing position (refer to FIG. 10). In this case, the pressure drop occurs in the fuel pressure of the first high-pressure passage 13, and an inflection point P1 appears at the detected pressure R (time t12). It can be determined that the inflection point P1 is caused by the valve opening operation of the second on-off valve 52. Therefore, in the pressure-reducing valve mode, after the energization pulse is turned on, the fuel pressure sensor 73 detects the inflection point P1 of the pressure drop, and the time from the valve opening command timing (time t11) to the timing when the inflection point P1 appears (time t12) is acquired as a valve opening delay time TdB of the second on-off valve 52.

(1-2) Injection Start (L) Mode

In the injection start (L) mode in which the rising speed of the injection rate is slowed down at the start of injection of the fuel injection valve 20, as illustrated in (b) in FIG. 11, in a state where the first on-off valve 51 and the second on-off valve 52 are closed, the first solenoid 53 is energized while the second solenoid 54 is not energized (time t21). When the first on-off valve 51 is opened by this energization, the fuel in the first control chamber 46 is discharged to the low-pressure chamber 57 via the third passage 42 and the first passage 25. Along with this, the needle valve 31 moves to the valve opening position. The pressure drop occurs in the fuel pressure of the first high-pressure passage 13, and an inflection point P2 appears at the detected pressure R (time t22). It can be determined that the inflection point P2 is caused by the valve opening operation of the first on-off valve 51. Therefore, in the injection start (L) mode, after the energization pulse is turned on, the fuel pressure sensor 73 detects the inflection point P2 of the pressure drop, and the time from the valve opening command timing (time t21) to the timing (time t22) when the inflection point P2 appears is acquired as a valve opening delay time TdA of the first on-off valve 51.

(1-3) Injection Start (H) Mode

In the injection start (H) mode in which the rising speed of the injection rate is steep at the start of injection, as illustrated in (c) in FIG. 11, in a state where the first on-off valve 51 and the second on-off valve 52 are closed, the first solenoid 53 and the second solenoid 54 are energized simultaneously (time t31). When the first on-off valve 51 and the second on-off valve 52 are opened by this energization, the fuel in the first control chamber 46 is discharged to the low-pressure chamber 57 via two passages, such as the fuel passage of the third passage 42 and the first passage 25, and the second passage 27. Along with this, the needle valve 31 moves to the valve opening position, the fuel pressure in the first high-pressure passage 13 decreases, and an inflection point P3 appears at the detected pressure R (time t32).

After the time t32 when the inflection point P3 appears, the fuel pressure gradually decreases. At this time, when an inclination θ of the pressure drop starting from the inflection point P3 corresponds to an inclination θ1 of the pressure-reducing valve mode, it can be determined that the inflection point P3 is caused by the fact that the second on-off valve 52 is switched from the closed state to the open state while the first on-off valve 51 is closed.

When an inflection point P4 of the pressure drop appears at a time t33 after the inflection point P3 appears, and the inclination θ of the pressure drop starting from an inflection point P4 is an inclination θ3 corresponding to the injection start (H) mode, it can be determined that the appearance of the inflection point P4 is due to the opening of the first on-off valve 51.

Therefore, after the energization pulse is turned on, the inflection point P (P3, P4) of the pressure drop and the inclination θ of the pressure drop are acquired by the fuel pressure sensor 73, and the valve opening delay time Td is computed using the acquired inflection point P. From the acquired inclination θ, it is specified whether each of the two inflection points P appearing after the energization pulse is turned on is caused by the valve opening delay of the first on-off valve 51 or the second on-off valve 52. Accordingly, the valve opening delay time TdA of the first on-off valve 51 and the valve opening delay time TdB of the second on-off valve 52 are separated and detected. In (c) in FIG. 11, since the inclination θ1 corresponding to the pressure-reducing valve mode is detected first after the energization pulse is turned on, the time from the valve opening command timing (time t31) to the timing (time t32) when the inflection point P3 appears is acquired as the valve opening delay time TdB of the second on-off valve 52. The time from the valve opening command timing (time t31) to the timing (time t33) when the inflection point P4 appears is acquired as the valve opening delay time TdA of the first on-off valve 51.

In the present embodiment, the correspondence between the on-off state of each of the first on-off valve 51 and the second on-off valve 52 and the inclination θ is stored in advance as, for example, a specific map. By comparing the correspondence with the inclination θ acquired currently, it is specified whether the inflection point P of the pressure drop acquired by the fuel pressure sensor 73 is caused by the valve opening delay of the first on-off valve 51 or the second on-off valve 52. Specifically, in the present embodiment, three types of inclinations, such as the inclination θ1 corresponding to the pressure-reducing valve mode (the first on-off valve 51 is closed and the second on-off valve 52 is open), an inclination θ2 corresponding to the injection start (L) mode (the first on-off valve 51 is open and the second on-off valve 52 is closed), and the inclination θ3 corresponding to the injection start (H) mode (both the first on-off valve 51 and the second on-off valve 52 are open), are stored in the storage unit. The inclination θ of each mode is stored according to the rail pressure.

In (d) in FIG. 11, it is assumed that the first on-off valve 51 is opened before the second on-off valve 52. In other words, as illustrated in (d) in FIG. 11, immediately after a time t42 when the inflection point P3 of the pressure drop is detected by the fuel pressure sensor 73, when the inclination θ of the detected pressure R is the inclination θ2 corresponding to the injection start (L) mode, it can be determined that the appearance of the inflection point P3 is caused by the opening of the first on-off valve 51. When the inflection point P4 of the pressure drop is detected again at a time t43 after the inflection point P3 is detected, and the inclination θ immediately after the inflection point P4 is detected is the inclination θ3 corresponding to the injection start (H) mode, it can be determined that the appearance of the inflection point P4 is caused by the opening of the second on-off valve 52. Therefore, in a case of (d) in FIG. 11, the time from the valve opening command timing (time t41) to the timing (time t42) when the inflection point P3 appears is acquired as the valve opening delay time TdA of the first on-off valve 51. The time from the valve opening command timing (time t41) to the timing (time t43) when the inflection point P4 appears is acquired as the valve opening delay time TdB of the second on-off valve 52.

When the inclination θ starting from the inflection point P that first appears after the energization of the first solenoid 53 and the second solenoid 54 is simultaneously started is the inclination θ3 corresponding to the injection start (H) mode, it is determined that the valve opening delays of the first on-off valve 51 and the second on-off valve 52 are simultaneous.

(1-4) Injection Start (L→H) Mode

In the injection start (L→H) mode, as illustrated in (e) in FIG. 11, in a state where the first on-off valve 51 and the second on-off valve 52 are closed, the first solenoid 53 is energized (time t51). After a predetermined time has elapsed from the start of energization of the first solenoid 53, the second solenoid 54 is energized (time t52). Along with the energization, the fuel in the first control chamber 46 is discharged to the low-pressure chamber 57, the needle valve 31 moves, the fuel pressure in the first high-pressure passage 13 decreases, and an inflection point P5 first appears at the detected pressure R (time t53).

At this time, when the inclination θ immediately after detecting the inflection point P5 is the inclination θ2 corresponding to the injection start (L) mode, it can be determined that the appearance of the inflection point P5 is caused by the fact that the first on-off valve 51 is switched from the open state to the closed state while the second on-off valve 52 is closed. When an inflection point P6 of the pressure drop is detected at a time t54 after a predetermined time has elapsed since the inflection point P5 is detected, and the inclination θ immediately after the inflection point P6 is detected is the inclination θ3 corresponding to the injection start (H) mode, it can be determined that the appearance of the inflection point P6 is caused by the fact that the second on-off valve 52 is switched from the closed state to the open state. Therefore, the valve opening delay time TdA of the first on-off valve 51 and the valve opening delay time TdB of the second on-off valve 52 can be respectively detected from the inflection points (P5, P6) and the inclination θ of the pressure drop after the energization pulse is turned on.

Specifically, in (e) in FIG. 11, the inclination θ2 corresponding to the injection start (L) mode is detected first after the energization pulse for the on-off valve 50 is turned on. In this case, the time from the output timing (time t51) of the drive command signal to the timing (time t 53) when the inflection point P5 appears is acquired as the valve opening delay time TdA of the first on-off valve 51. The time from the switching timing (time t52) of the injection rate mode to the timing (time t54) when the inflection point P6 appears is acquired as the valve opening delay time TdB of the second on-off valve 52.

(1-5) When Shifting from Pressure-Reducing Valve Mode to Injection Start (H) Mode In the pressure-reducing valve mode, as illustrated in (f) in FIG. 11, in a state where the first on-off valve 51 and the second on-off valve 52 are closed, the second solenoid 54 is first energized (time t61). After this, when the mode shifts to the injection start (H) mode, the first solenoid 53 is energized at a time t62 when the request is made. When the on-off valve 50 is opened by these energization, the fuel pressure in the first high-pressure passage 13 decreases, and an inflection point P7 appears at the detected pressure R (time t63).

Immediately after detecting the inflection point P7 of the detected pressure R, when the inclination θ is the inclination θ1 corresponding to the pressure-reducing valve mode, it can be determined that the appearance of the inflection point P7 is caused by the fact that the second on-off valve 52 is switched from the closed state to the open state while the first on-off valve 51 is closed. When an inflection point P8 of the pressure drop is detected again at a time t64 after the inflection point P7 is detected, and the inclination θ immediately after the inflection point P8 is detected is the inclination θ3 corresponding to the injection start (H) mode, it can be determined that the appearance of the inflection point P8 is further caused by the fact that the first on-off valve 51 is switched from the closed state to the open state. In other words, in a case of (f) in FIG. 11, the valve opening delay times TdA and TdB can be respectively detected from the inflection points (P7 and P8) and the inclination θ that appear after the energization pulse is turned on.

Specifically, in (f) in FIG. 11, since the inclination θ1 corresponding to the pressure-reducing valve mode is detected first after the energization pulse is turned on, the time from the timing (time t61) of the command of the injection start to the timing (time t63) when the inflection point P7 appears is acquired as the valve opening delay time TdB of the second on-off valve 52. The time from the switching timing (time t62) of the injection rate mode to the timing (time t64) when the inflection point P8 appears is acquired as the valve opening delay time TdA of the first on-off valve 51.

Figure 12:
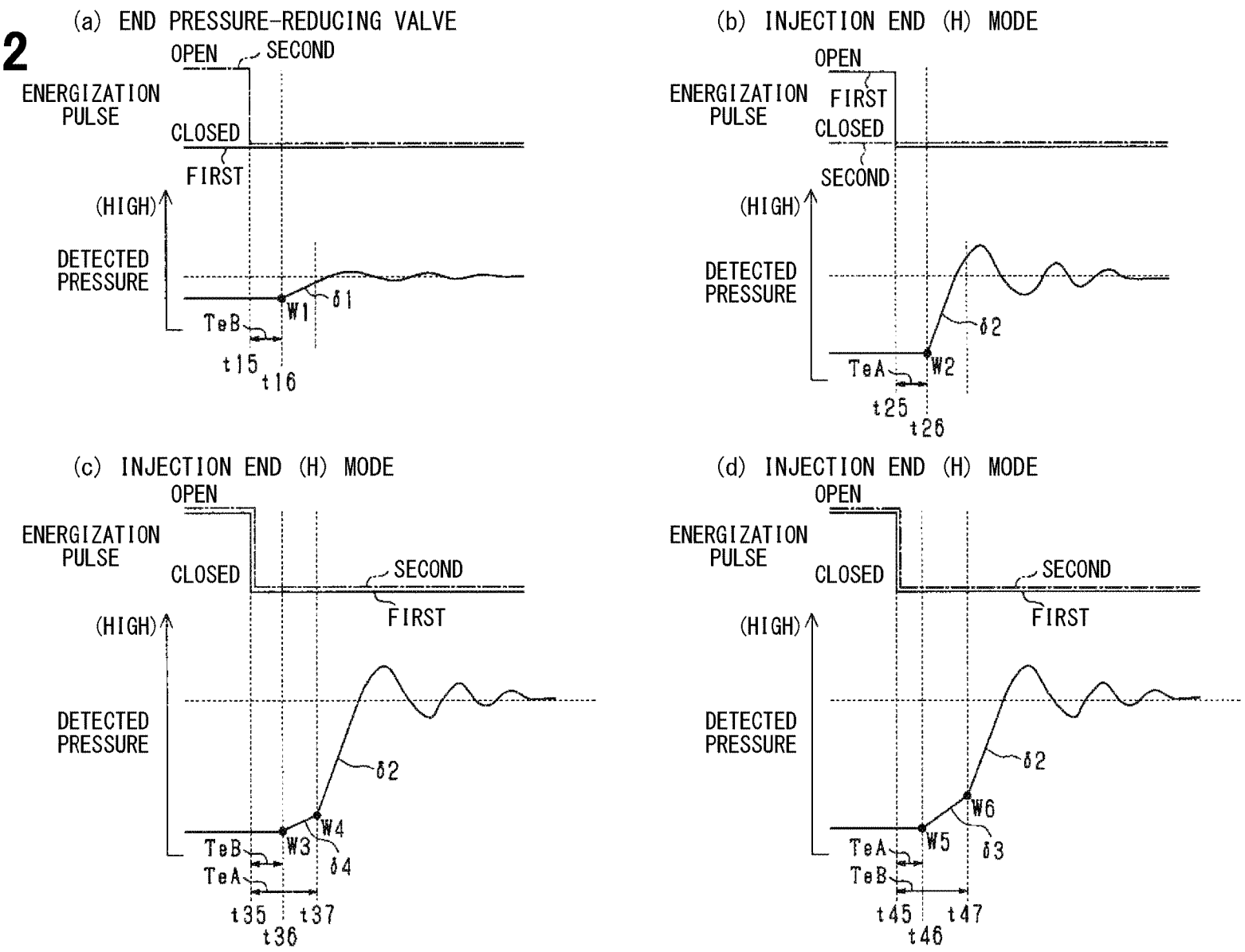
FIG. 12 is a view describing a process of computing a valve closing delay time.

Next, the process of computing the valve closing delay time Te will be described with reference to FIG. 12. FIG. 12 illustrates an example of the acquisition mode of the valve closing delay time Te at the end of the pressure-reducing valve mode and in each injection rate mode. The upper and lower parts in FIG. 12 illustrate the transitions of the energization pulse and the detected pressure R for the first on-off valve 51 and the second on-off valve 52, respectively, as in FIG. 11.

(2-1) Pressure-Reducing Valve Mode

In the pressure-reducing valve mode, as illustrated in (a) in FIG. 12, in a state where the first on-off valve 51 is closed and the second on-off valve 52 is open, the energization of the second solenoid 54 is stopped by turning off the energization pulse of the second on-off valve 52 (time t15). When the second on-off valve 52 is closed by stopping the energization, the communication between the first control chamber 46 and the low-pressure chamber 57 is shut off. Accordingly, the fuel pressure of the first high-pressure passage 13 is restored, and an inflection point W1 appears at the detected pressure R (time t16). It can be determined that this inflection point W1 is caused by the valve closing operation of the second on-off valve 52. Therefore, at the end of the pressure-reducing valve mode, after the energization pulse is turned off with respect to the second on-off valve 52, the fuel pressure sensor 73 acquires the inflection point W1, and the time from the valve closing command timing (time t15) to the timing (time t16) when the inflection point W1 appears is acquired as a valve closing delay time TeB of the second on-off valve 52.

(2-2) Injection End (H) Mode

As illustrated in (b) in FIG. 12, when the fuel injection is stopped in the injection end (H) mode in a state where the first on-off valve 51 is open and the second on-off valve 52 is closed, the energization of the first solenoid 53 is stopped as the energization pulse of the first on-off valve 51 is turned off (time t25). When the first on-off valve 51 is closed by stopping the energization, the communication between the first control chamber 46 and the low-pressure chamber 57 is shut off, and accordingly, the fuel pressure of the first high-pressure passage 13 is restored and an inflection point W2 appears at the detected pressure R (time t26). It can be determined that this inflection point W2 is caused by the valve closing operation of the first on-off valve 51. Therefore, after the pulse is turned off through the first on-off valve 51, the fuel pressure sensor 73 detects the inflection point W2 of the pressure drop, and the time from the valve closing command timing (time t25) to the timing (time t26) when the inflection point W2 appears is acquired as a valve closing delay time TeA of the first on-off valve 51.

(2-3) Injection End (H) Mode

As illustrated in (c) in FIG. 12, when the fuel injection is stopped in the injection end (H) mode in a state where the first on-off valve 51 and the second on-off valve 52 are open, first, the energization of the first solenoid 53 and the second solenoid 54 is stopped simultaneously (time t35). According to the stop of the energization, the fuel pressure of the first high-pressure passage 13 rises, and an inflection point W3 appears at the detected pressure R (time t36). Immediately after the inflection point W3 is detected, an inclination δ of the pressure increase of the detected pressure R is an inclination δ4 smaller than the inclination δ4 corresponding to the injection end (L) mode. In this case, it can be determined that the inflection point W3 is caused by the fact that the second on-off valve 52 is switched from the open state to the closed state first while the first on-off valve 51 is open. Therefore, the time from the valve closing command timing (time t35) to the timing (time t36) when the inflection point W3 appears is acquired as the valve closing delay time TeB of the second on-off valve 52.

At a time t37 after the inflection point W3 appears, an inflection point W4 for pressure recovery is detected, and the inclination δ immediately after the inflection point W4 is an inclination δ2 corresponding to the injection end (H) mode. In this case, it can be determined that the appearance of the inflection point W4 is caused by the closing of the first on-off valve 51. Therefore, the time from the valve closing command timing (time t35) to the timing (time t37) when the inflection point W4 appears is acquired as the valve closing delay time TeA of the first on-off valve 51.

Meanwhile, in (d) in FIG. 12, when the energization of the first solenoid 53 and the second solenoid 54 is stopped simultaneously and accordingly an inflection point W5 appears at the detected pressure R, the inclination δ immediately after the inflection point W5 is an inclination δ3 corresponding to the injection end (L) mode. In this case, it can be determined that an inflection point W6 is caused by the fact that the first on-off valve 51 is switched from the open state to the closed state first while the second on-off valve 52 is open. Therefore, the time from the valve closing command timing (time t45) to the timing (time t46) when the inflection point W5 appears is acquired as the valve closing delay time TeA of the first on-off valve 51.

When the inflection point W6 appears at a time t47 after the inflection point W5 is acquired and the inclination δ after the inflection point W6 is the inclination δ2 corresponding to the injection end (H) mode, it can be determined that the appearance of the inflection point W6 is caused by the closing of the second on-off valve 52. Therefore, the time from the valve closing command timing (time t45) to the timing (time t47) when an inflection point P14 appears is acquired as the valve closing delay time TeB of the second on-off valve 52.

In the valve closing delay computation process, similar to the valve opening delay computation process, the correspondence between the on-off state of each of the first on-off valve 51 and the second on-off valve 52 and the inclination δ is stored in advance as a specific map. By comparing the correspondence with the inclination δ acquired currently, it is specified whether the inflection point W of the pressure recovery acquired by the fuel pressure sensor 73 is caused by the valve closing delay of the first on-off valve 51 or the second on-off valve 52. Specifically, three types of inclinations, such as the inclination δ1 corresponding to the pressure-reducing valve mode (when only the second on-off valve 52 is switched from the open state to the close state), the inclination δ2 corresponding to the injection end (H) mode (both the first on-off valve 51 and the second on-off valve 52 are closed), and the inclination δ3 corresponding to the injection end (L) mode (the first on-off valve 51 is closed and the second on-off valve 52 is open), are stored in the storage unit. The inclination δ of each mode is stored according to the rail pressure.

When the energization of the first solenoid 53 and the second solenoid 54 is stopped simultaneously in a situation where the first solenoid 53 and the second solenoid 54 are energized, and when the inclination δ starting from the inflection point W of the pressure recovery appeared first after the stop of the energization is the inclination δ2 corresponding to the injection start (H) mode, it is determined that the valve closing delay of the first on-off valve 51 and the second on-off valve 52 are simultaneous.

Figure 13:
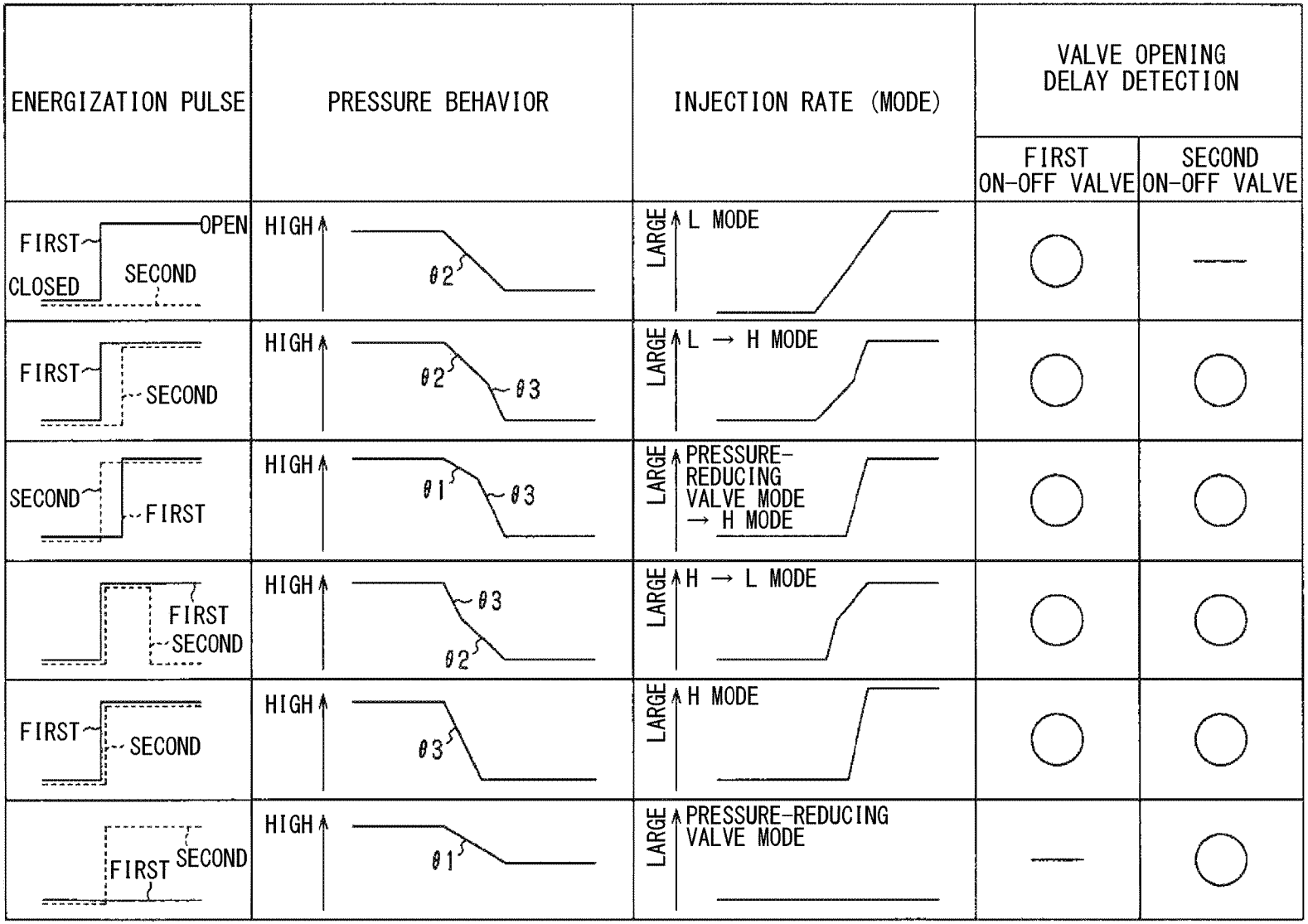
FIG. 13 is a view illustrating a correspondence between an injection rate mode and the valve opening delay time.
Figure 14:
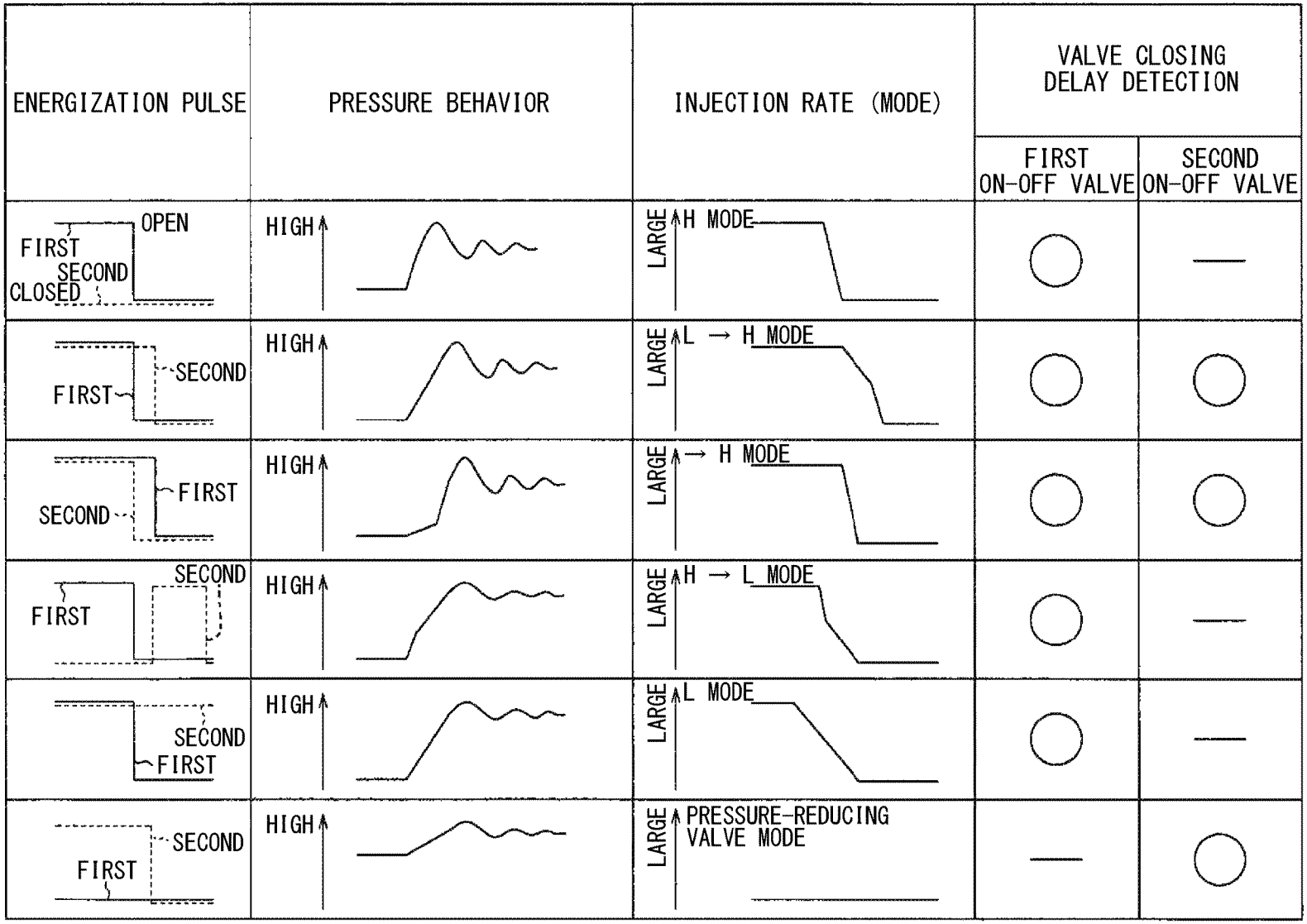
FIG. 14 is a view illustrating a correspondence between the injection rate mode and the valve closing delay time.

FIG. 13 illustrates the correspondence between the injection rate mode and the valve opening delay time Td, and FIG. 14 illustrates the correspondence between the injection rate mode and the valve closing delay time Te. FIGS. 13 and 14 illustrate that the delay time corresponding to the column marked with a circle in the columns of "whether or not valve opening delay can be detected" and "whether or not valve closing delay can be detected" can be detected. As can be seen from FIGS. 13 and 14, according to the behavior of the detected pressure R when the first on-off valve 51 and the second on-off valve 52 are switched between the open state and the closing state, the valve opening delay time Td and the valve closing delay time Te can be separately detected for each of the first on-off valve 51 and the second on-off valve 52. In FIG. 14, in the pressure-reducing valve mode, when there is no pressure recovery after pressure reduction, the valve closing delay time TeB cannot be detected.

Next, the processing procedure of the response delay time computation process will be described with reference to the flowcharts of FIGS. 15 to 18. This process is executed by the microcomputer of the ECU 90 at each predetermined cycle.

In FIG. 15, in step S101, it is determined whether or not there is an injection start request for injecting fuel from the fuel injection valve 20. When there is a request to start injection, the process proceeds to step S102, and it is determined whether or not to increase the valve opening speed of the needle valve 31. Here, the determination is made based on the engine operating state (engine rotation speed, engine load, and the like). When an affirmative determination is made in step S102, the process proceeds to step S103, and the energization for the injection start (H) mode is performed. Specifically, the first solenoid 53 and the second solenoid 54 are energized simultaneously.

In the following step S104, by using the detected pressure R after the energization of the first solenoid 53 and the second solenoid 54 is started, as the valve opening delay information for computing the valve opening delay times TdA and TdB of each of the first on-off valve 51 and the second on-off valve 52, the information on the inflection point P of the pressure drop and the inclination θ of the pressure drop starting from the inflection point P are acquired (refer to (c) and (d) in FIG. 11). The information on the inflection point P includes the time required from the start of energization to the appearance of the inflection point P.

In step S105, it is determined whether or not to switch the valve opening speed of the needle valve 31 from high speed to low speed on the way to reach the maximum injection rate. When an affirmative determination is made in step S105, the process proceeds to step S106, and the switching to the energization for the injection start (H→L) mode is performed. Specifically, the energization of the second solenoid 54 is stopped while the energization of the first solenoid 53 is continued. After this, in step S107, the injection end request is acquired at the timing when a predetermined period has elapsed from the timing of the injection start request. The time from the injection start request to the injection end request is computed based on the engine operating state (engine rotation speed and engine load) each time.

When there is a request to end injection, the process proceeds to the following step S108, and it is determined whether or not to increase the valve closing speed of the needle valve 31. When moving the needle valve 31 at high speed, the process proceeds to step S109, and the energization for the injection end (H) mode is performed. Specifically, the energization of the first solenoid 53 and the second solenoid 54 is stopped. In the following step S110, by using the detected pressure R after the energization of the first solenoid 53 and the second solenoid 54 is stopped, as the valve opening delay information for computing the valve closing delay time TeA of the first on-off valve 51, the information on the inflection point W of the pressure recovery is acquired (refer to (c) and (d) in FIG. 12). The information on the inflection point W includes the time required from the end of energization to the appearance of the inflection point W. At this time, the inclination δ of the pressure recovery starting from the inflection point W may be acquired together as the valve opening delay information.

In the following step S111, it is determined whether or not to switch the valve closing speed of the needle valve 31 from high speed to low speed on the way until the injection rate reaches zero. When an affirmative determination is made in step S111, the process proceeds to step S112, and the switching to the energization for the injection end (H→L) mode is performed. Specifically, the energization of the second solenoid 54 is restarted while the energization of the first solenoid 53 is stopped. After this, in step S113, the energization of the second solenoid 54 is stopped after a predetermined time has elapsed from the restart of energization of the second solenoid 54, and the process proceeds to step S114. Meanwhile, when a negative determination is made in step S111 (that is, when the injection end (H) mode is continued), the process proceeds to step S114 without performing the processes of steps S112 and S113.

In step S114, the valve opening delay times TdA and TdB and the valve closing delay time TeA are respectively computed by using the information on the inflection points P and W and the inclinations θ and δ acquired at the time of opening and closing the fuel injection valve 20, respectively. Specifically, by using the acquired inclination θ and the specific map, it is specified which of the first on-off valve 51 and the second on-off valve 52 causes the inflection point P to appear, and the time length of the valve opening delay time Td is computed from the information on the inflection point P. By computing the time length of the valve closing delay time Te from the information on the inflection point W, the valve opening delay times TdA and TdB and the valve closing delay time TeA are computed, respectively.

In step S114, the injection learning value is updated by the computed valve opening delay times TdA and TdB and the valve closing delay time TeA. The updated injection learning value is used to correct the drive command signals of each of the first on-off valve 51 and the second on-off valve 52. The learning period is set during normal engine operation, and by using the multiple valve opening delay times TdA and TdB and the valve closing delay times TeA and TeB acquired during the learning period, the injection learning value of each of the first on-off valve 51 and the second on-off valve 52 may be computed.

When a negative determination is made in step S108, the process proceeds to step S115, and the energization for the injection end (L) mode is performed. Specifically, the energization of the first solenoid 53 is stopped, and the energization of the second solenoid 54 is restarted. In the following step S116, by using the detected pressure R after the energization of the first solenoid 53 is stopped, as the valve closing delay information for computing the valve closing delay time TeA of the first on-off valve 51, the information on the inflection point W of the pressure recovery and the inclination δ of the pressure recovery starting from the inflection point W are acquired.

In the following step S117, it is determined whether or not to switch the valve closing speed of the needle valve 31 from low speed to high speed on the way until the injection rate reaches zero. When an affirmative determination is made in step S117, the process proceeds to step S118, and the switching to the energization for the injection end (L→H) mode is performed. Specifically, in addition to the first solenoid 53, the energization of the second solenoid 54 is also stopped.

In the step S119, by using the detected pressure R after the energization of the second solenoid 54 is stopped, as the valve closing delay information for computing the valve closing delay time TeB of the second on-off valve 52, the information on the inflection point W of the pressure recovery and the inclination δ of the pressure recovery starting from the inflection point W are acquired. After this, the process proceeds to step S114, and the response delay time is computed by using the valve opening delay information and the valve closing delay information. Meanwhile, when a negative determination is made in step S117, the energization of the second solenoid 54 is stopped after a predetermined time has elapsed from the restart of energization of the second solenoid 54 (step S120), and the process proceeds to step S114.

Figure 16:
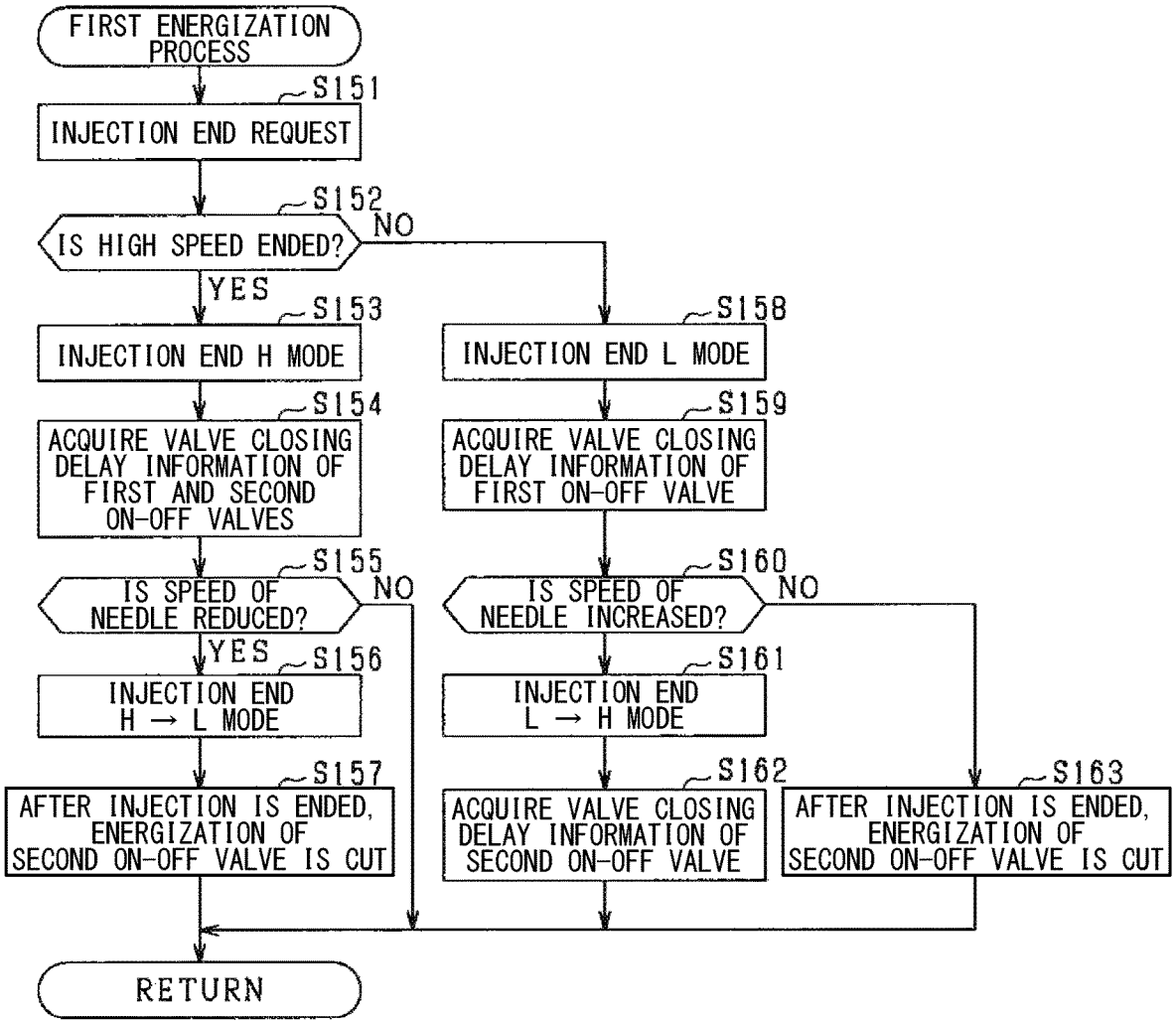
FIG. 16 is a subroutine of a first energization process.

In FIG. 15, when a negative determination is made in step S105, that is, when the valve opening speed of the needle valve 31 remains high at the start of injection, the process proceeds to step S150, and the subroutine of the first energization process illustrated in FIG. 16 is executed.

In FIG. 16, in steps S151 to S157, the same process as that in steps S107 to S113 of FIG. 15 described above is executed. However, in step S154, as the valve closing delay information for computing the valve closing delay times TeA and TeB of the first on-off valve 51 and the second on-off valve 52, the information on the inflection point W and the inclination δ of the pressure recovery starting from the inflection point W are acquired from the detected pressure R after the energization of the first solenoid 53 and the second solenoid 54 is stopped (refer to (c) and (d) in FIG. 12).

When a negative determination is made in step S152, the process proceeds to step S158, and the energization for the injection end (L) mode is performed. Here, the energization of the first solenoid 53 is stopped while the energization of the second solenoid 54 is continued. In steps S159 to S163, the same process as that in steps S116 to S120 of FIG. 15 described above is executed.

Figure 17:
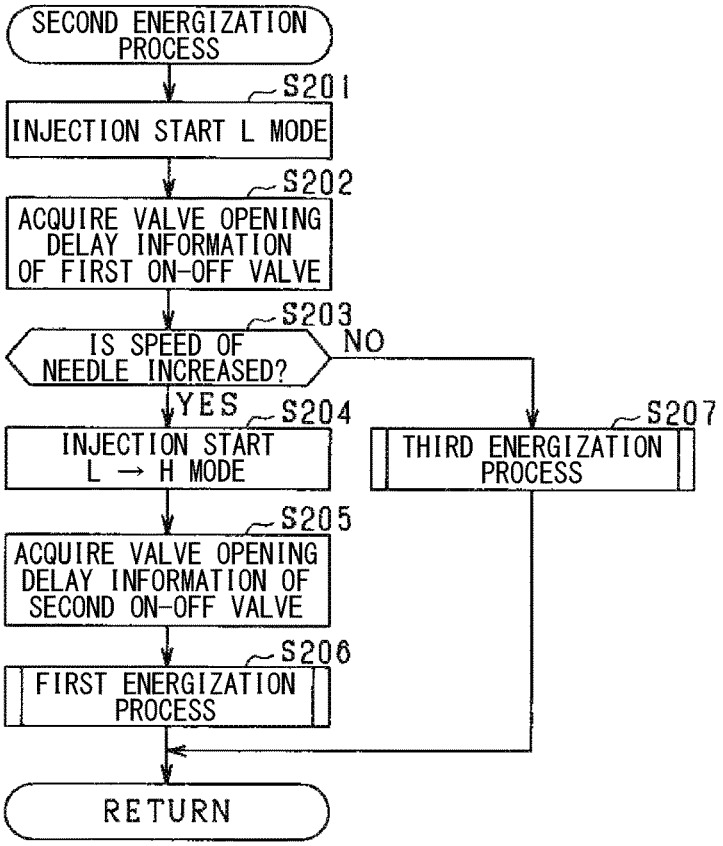
FIG. 17 is a subroutine of a second energization process.

Returning to the description of FIG. 15, when a negative determination is made in step S102, that is, when the valve opening speed of the needle valve 31 is lowered during the rising period of the injection rate after the injection start request, the process proceeds to step S200, and the subroutine of the second energization process illustrated in FIG. 17 is executed.

In FIG. 17, in step S201, the energization for the injection start (L) mode is performed. Here, the energization of the first solenoid 53 is started while the energization of the second solenoid 54 is stopped. In the following step S202, by using the detected pressure R after the energization of the first solenoid 53 is started, as the valve opening delay information for computing the valve opening delay time TdA of the first on-off valve 51, the information on the inflection point P of the pressure drop is acquired (refer to (b) in FIG. 11). At this time, the inclination θ of the pressure drop starting from the inflection point P may also be acquired.

In step S203, it is determined whether or not to switch the valve opening speed of the needle valve 31 from low speed to high speed on the way to reach the maximum injection rate. When an affirmative determination is made in step S203, the process proceeds to step S204, and the switching to the energization for the injection start (L→H) mode is performed. Here, in addition to the energization of the first solenoid 53, the energization of the second solenoid 54 is started. In the following step S205, by using the detected pressure R after the energization of the second solenoid 54 is started, as the valve opening delay information for computing the valve opening delay time TdB of the second on-off valve 52, the information on the inflection point P of the pressure drop and the inclination θ of the pressure drop starting from the inflection point P are acquired (refer to (e) in FIG. 11). In step S206, the subroutine of the first energization process illustrated in FIG. 16 is executed. Then, in step S114, the response delay time is computed. The injection learning value is updated according to the computed response delay time.

Meanwhile, when a negative determination is made in step S203, the process proceeds to step S207, and the subroutine of the third energization process is executed. The third energization process is a process executed when the fuel injection is ended from the state where the first on-off valve 51 is open and the second on-off valve 52 is closed, and includes the process of steps S107 to S120 of FIG. 15. In other words, when a negative determination is made in step S203, the same process as that in steps S107 to S120 of FIG. 15 is executed. After this, the process of step S114 is executed, and this routine is ended.

Returning to the description of FIG. 15, when a negative determination is made in step S101, that is, when there is no injection start request, the process proceeds to step S121, and it is determined whether or not to reduce the pressure of the common rail 11. When a negative determination is made in step S121, this routine is ended as it is. Meanwhile, when an affirmative determination is made in step S121, the process proceeds to step S300, and the subroutine of the pressure-reducing valve mode process illustrated in FIG. 18 is executed.

Figure 18:
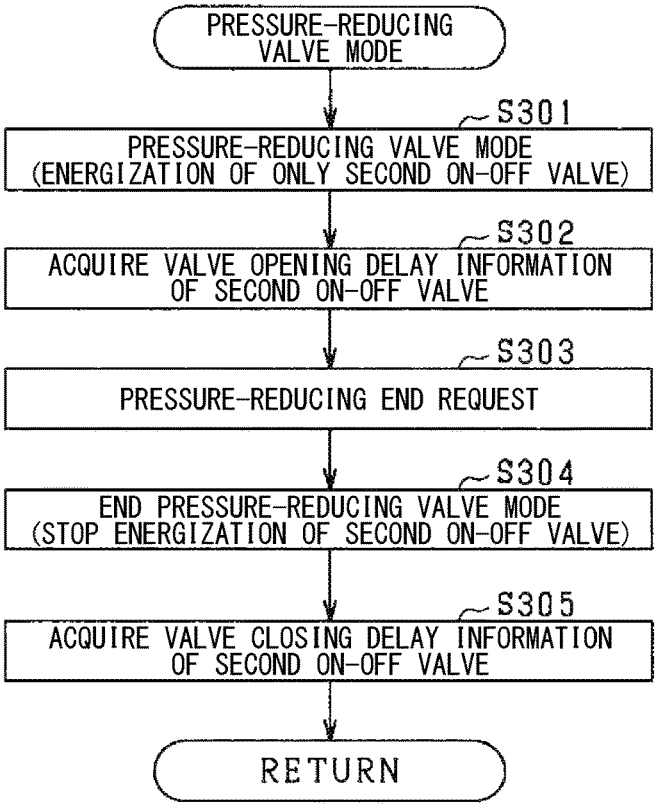
FIG. 18 is a subroutine of pressure-reducing valve mode process.

In FIG. 18, in step S301, the energization of the second solenoid 54 is started while the energization of the first solenoid 53 is stopped as the energization for the pressure-reducing valve mode. In the step S302, by using the detected pressure R after the energization of the second solenoid 54 is started, as the valve opening delay information for computing the valve opening delay time TdB of the second on-off valve 52, the information on the inflection point P of the pressure drop and the inclination θ of the pressure drop starting from the inflection point P are acquired (refer to (a) in FIG. 11).

In the following step S303, when the common rail pressure drops to the target pressure, a pressure-reducing end request is input. When the pressure-reducing end request is made, the energization of the second solenoid 54 is stopped in step S304, and the pressure-reducing valve mode is ended. In the step S305, by using the detected pressure R after the energization of the second solenoid 54 is stopped, as the valve closing delay information for computing the valve closing delay time TeB of the second on-off valve 52, the information on the inflection point W of the pressure recovery and the inclination δ of the pressure recovery starting from the inflection point W are acquired (refer to (a) in FIG. 12). After this, the process returns to the main routine of FIG. 15, and the process of step S114 is executed.

According to the present embodiment described in detail above, the following excellent effects can be obtained.

In the fuel injection valve having the above-described configuration, focusing on the fact that the behavior of the pressure change of the fuel pressure in the control chamber differs depending on the combination of the on-off state of the first on-off valve and the on-off state of the second on-off valve, after the output of the drive command signal (the energization pulse of the first on-off valve 51 and the energization pulse of the second on-off valve 52), the inflection points P and W of the fuel pressure detected by the fuel pressure sensor 73 and the inclinations θ and δ of the fuel pressure after the inflection points P and W appeared, are acquired. Then, the response delay time of the on-off valve 50 with respect to the drive command signal is computed for each of the first on-off valve 51 and the second on-off valve 52 based on the acquired inflection points P and W and the inclinations θ and δ. According to this configuration, it is possible to specify whether the response delay of the on-off valve 50 is caused by the valve opening and closing of the first on-off valve 51 or the second on-off valve 52. Accordingly, the response delay of the pressure adjusting valve can be detected accurately, and the accuracy of the fuel injection system can further be improved.

Specifically, by using the inclination θ starting from the inflection point P of the pressure drop, the valve opening delay time Td is computed by specifying whether the inflection point P is caused by the valve opening of the first on-off valve 51 or the second on-off valve 52. Similarly, by using the inclination δ starting from the inflection point W of the pressure recovery, the valve closing delay time Te is computed by specifying whether the inflection point W is caused by the valve closing of the first on-off valve 51 or the second on-off valve 52. With such a configuration, the response delay time of the first on-off valve 51 and the response delay time of the second on-off valve 52 can be separated and detected according to the detection value of one fuel pressure sensor 73.

When the pressure-reducing start timing and the pressure-reducing end timing cannot be controlled accurately in the pressure-reducing valve mode, the rail pressure cannot be controlled accurately, and there is a concern that inconveniences such as excessive output or insufficient output, emission, and deterioration of fuel consumption occur. In this regard, according to the configuration of the present embodiment, even in the pressure-reducing valve mode in which only the second on-off valve 52 is opened, the response delay of the second on-off valve 52 can be accurately reflected and the second on-off valve 52 can be driven and controlled. Accordingly, the accuracy of the pressure-reducing start timing and the pressure-reducing end timing can be improved.

By using the computed valve opening delay times Tda and Tdb and the valve closing delay times Tea and Teb, the drive command signal is corrected for each of the first on-off valve 51 and the second on-off valve 52. Accordingly, it is possible to improve the accuracy of the drive start timing and the drive end timing of each of the first on-off valve 51 and the second on-off valve 52.

Other Embodiments

The present disclosure is not limited to the above-described embodiment, and may be implemented as follows, for example.

The attaching position of the fuel pressure sensor 73 may be any position in the high-pressure fuel passage where the pressure changes in conjunction with the pressure change in the first control chamber 46 accompanying the drive of the on-off valve 50, and is not limited to the position illustrated in FIG. 1. For example, the attaching position may be provided at the position of the second main body portion 22 or the third main body portion 23 in the first high-pressure passage 13. Otherwise, the attaching position may be provided on the upstream side of the boosting orifice 14*a* in the second high-pressure passage 14.

The configuration of the fuel injection valve 20 is not limited to the configuration illustrated in FIG. 1. For example, in the fuel injection valve 20 of FIG. 1, in a state where the driven valve 41 shuts off the first high-pressure passage 13 and the first control chamber 46, the second passage 27 may be formed inside the driven valve 41 and communicate with the first control chamber 46 via another passage different from the third passage 42. Otherwise, in a state where the second passage 27 communicates with the intermediate chamber 26 and the driven valve 41 shuts off the first high-pressure passage 13 and the first control chamber 46, the second passage 27 may communicate with the first control chamber 46 via the intermediate chamber 26 and the third passage 42.

In the fuel injection valve 20 of FIG. 1, two or more on-off valves are provided as the second on-off valve 52 for adjusting the movement speed of the needle valve 31, the opening and closing of these two or more on-off valves is individually controlled, and accordingly, the movement speed of the needle valve 31 may be further adjusted with higher accuracy. In this case, the flow rate of fuel through the boosting orifice 14*a* is set to be larger than the total flow rate of fuel through the pressure-reducing orifices provided in the respective fuel passages of the two or more on-off valves.

The control unit and the method described in the present disclosure may be implemented by a special purpose computer which is configured with a memory and a processor programmed to execute one or more particular functions embodied in computer programs of the memory. Alternatively, the controller and the method described in the present disclosure may be implemented by a special purpose computer configured as a processor with one or more special purpose hardware logic circuits. Alternatively, the controller and the method described in the present disclosure may be implemented by one or more special purpose computer, which is configured as a combination of a processor and a memory, which are programmed to perform one or more functions, and a processor which is configured with one or more hardware logic circuits. The computer programs may be stored, as instructions to be executed by a computer, in a tangible non-transitory computer-readable medium.

Although the present disclosure has been described in accordance with the examples, it is understood that the present disclosure is not limited to such examples or structures. The present disclosure encompasses various modifications and variations within the scope of equivalents. In addition, while the various combinations and configurations, which are preferred, other combinations and configurations, including more, less or only a single element, are also within the spirit and scope of the present disclosure.

What is claimed is:

1. A fuel injection system including an accumulator container configured to accumulate fuel in a high-pressure state, and a fuel injection valve configured to inject high-pressure fuel in the accumulator container to a cylinder of an internal combustion engine, wherein the fuel injection valve includes a control chamber configured to be supplied with the high-pressure fuel from the accumulator container through a high-pressure fuel passage, a needle valve configured to move in an axial direction according to a fuel pressure inside the control chamber to open an injection hole to inject the fuel, and a pressure adjusting valve placed in a fuel passage connected to the control chamber and configured to allow and to shut off an outflow of the fuel from the control chamber to adjust the fuel pressure inside the control chamber, the fuel passage includes a first fuel passage having a first orifice and a second fuel passage having a second orifice that is configured to limit a flow rate of the fuel through a flow passage area different from a flow passage area of the first orifice, the pressure adjusting valve includes a first on-off valve placed in the first fuel passage and a second on-off valve placed in the second fuel passage, and the system comprising:

a pressure detection unit configured to detect the fuel pressure in the high-pressure fuel passage;

a drive control unit configured to control opening and closing of the pressure adjusting valve based on a drive command signal output to the fuel injection valve;

an acquisition unit configured to acquire an inflection point of the fuel pressure detected by the pressure detection unit and an inclination of the fuel pressure after the inflection point appears, after an output of the drive command signal; and a delay time computation unit configured to compute a response delay time of the pressure adjusting valve with respect to the drive command signal for each of the first on-off valve and the second on-off valve based on the inflection point and the inclination acquired by the acquisition unit.

2. The fuel injection system according to claim 1, wherein the delay time computation unit is configured to compute the response delay time of the pressure adjusting valve with respect to the drive command signal for each of the first on-off valve and the second on-off valve and specify whether the appearance of the inflection point is caused by a response delay of the first on-off valve or a response delay of the second on-off valve based on the inclination.

3. The fuel injection system according to claim 2, further comprising:

a storage unit configured to store a correspondence between the inclination and an on-off state of each of the first on-off valve and the second on-off valve, wherein the delay time computation unit is configured to specify whether the appearance of the inflection point is caused by the response delay of the first on-off valve or the response delay of the second on-off valve based on the correspondence stored in the storage unit and the inclination acquired currently by the acquisition unit.

4. The fuel injection system according to claim 1, further comprising:

a pressure-reducing control unit configured to open the second on-off valve while the first on-off valve is closed to discharge the fuel from the control chamber to reduce the fuel pressure inside the accumulator container without injecting the fuel from the injection hole.

5. The fuel injection system according to claim 1, further comprising:

an injection correction unit configured to correct the drive command signal for each of the first on-off valve and the second on-off valve by using the response delay time computed by the delay time computation unit.

* * * * *